US006733105B2

(12) United States Patent
Tatsumi

(10) Patent No.: US 6,733,105 B2
(45) Date of Patent: May 11, 2004

(54) IMAGE RECORDING METHOD AND INK JET PRINTER

(75) Inventor: Setsuji Tatsumi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/290,309

(22) Filed: Nov. 8, 2002

(65) Prior Publication Data

US 2003/0090555 A1 May 15, 2003

(30) Foreign Application Priority Data

Nov. 8, 2001 (JP) ..... 2001-342935

(51) Int. Cl.[7] ..... B41J 2/015
(52) U.S. Cl. ..... 347/21; 347/3; 347/98
(58) Field of Search ..... 347/98, 21, 3, 347/101

(56) References Cited

U.S. PATENT DOCUMENTS 5,835,116 A * 11/1998 Sato et al. ..... 347/98
6,439,708 B1 * 8/2002 Kato et al. ..... 347/98
6,443,568 B1 * 9/2002 Askeland et al. ..... 347/98

FOREIGN PATENT DOCUMENTS

JP 5-135155 6/1993
JP 7-66436 7/1995
JP 8-39841 2/1996
JP 2001-108421 4/2001

OTHER PUBLICATIONS

Otsuki, et al.; "Extraction of Specular Reflection Using Multiple Color and Range Images"; The Institute of Electronics, Information and Communication Engineers Transaction, D–II vol. J–80–D–II No. 6; pp. 1352–1359; Jun. 1997.

* cited by examiner

*Primary Examiner*—Hai Pham
*Assistant Examiner*—Lam S Nguyen
(74) *Attorney, Agent, or Firm*—Sughrue Mion, PLLC

(57) ABSTRACT

The image recording method records an image of a still subject on a recording medium using a diffuse reflection image signal of the image representing the still subject under a state where illumination light is diffuse-reflected and a glossiness signal representing glossiness of the still subject. The method forms a diffuse reflection image of the still subject on the recording medium based on the diffuse reflection image signal and forms a gloss adjustment layer made of a transparent gloss adjustment material in each region in units of pixels of the diffuse reflection image formed on the recording medium based on signal values of the glossiness signal.

18 Claims, 11 Drawing Sheets

FIG.4A

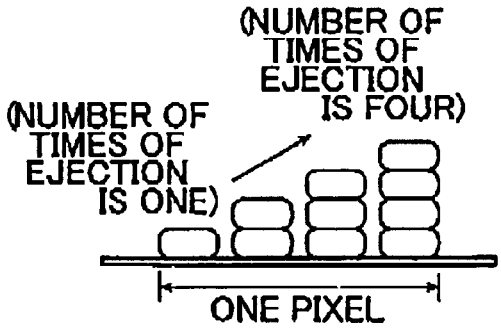

FIG.4B

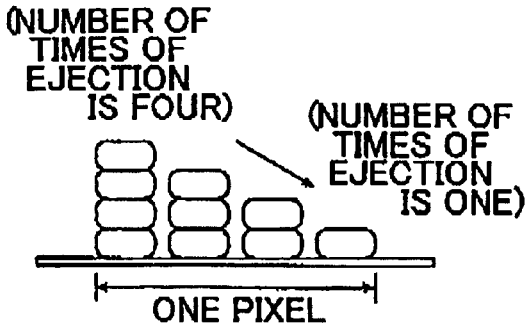

FIG.5A

- MAIN SCANNING DIRECTION $R_1$:3
- CONVEYING DIRECTION $R'_2$:3

MAIN SCANNING DIRECTION →

CONVEYING DIRECTION ↑

| | | | |
|---|---|---|---|
| 1 | 2 | 3 | 4 |
| 1 | 2 | 3 | 4 |
| 1 | 2 | 3 | 4 |
| 1 | 2 | 3 | 4 |

FIG.5B

- MAIN SCANNING DIRECTION $R_2$:3
- CONVEYING DIRECTION $R'_1$:3

MAIN SCANNING DIRECTION →

CONVEYING DIRECTION ↑

| | | | |
|---|---|---|---|
| 1 | 1 | 1 | 1 |
| 2 | 2 | 2 | 2 |
| 3 | 3 | 3 | 3 |
| 4 | 4 | 4 | 4 |

FIG.5C

- MAIN SCANNING DIRECTION $R_1$:3
- CONVEYING DIRECTION $R'_1$:3

MAIN SCANNING DIRECTION →

CONVEYING DIRECTION ↑

| | | | |
|---|---|---|---|
| 1 | 2 | 2 | 3 |
| 2 | 2 | 3 | 3 |
| 2 | 3 | 3 | 4 |
| 3 | 3 | 4 | 4 |

FIG.5D

- MAIN SCANNING DIRECTION $R_1$:3
- CONVEYING DIRECTION $R'_2$:1

MAIN SCANNING DIRECTION →

CONVEYING DIRECTION ↑

| | | | |
|---|---|---|---|
| 1 | 2 | 3 | 4 |
| 1 | 2 | 3 | 0 |
| 0 | 2 | 0 | 4 |
| 1 | 2 | 3 | 4 |

$$\alpha = \frac{W+2X_0}{N}$$

IMAGE RECORDING METHOD AND INK JET PRINTER

BACKGROUND OF THE INVENTION

1. Field of the Invention

The present invention relates to an image recording method with which texture, such as the glossy feeling of the surface of a still subject or the fine texture of a fiber fabric, is represented on a recording medium such as recording paper. The present invention also relates to an ink jet printer that carries out the image recording method.

2. Description of the Related Art

Nowadays, it is possible to obtain a high-quality image by capturing a subject with a scanner or a camera. However, it is difficult to reproduce the texture of a subject having a substantially plane shape, such as the glossy feeling of the subject or the fine unevenness of the surface of the subject, with a captured image obtained by photographing the subject.

As a method of representing the texture of a subject, it is possible to cite processing based on a computer graphics (CG) technique. For instance, a specular reflectivity, a diffuse reflectivity, and the like that are information representing the texture of the subject are defined for three-dimensional data representing the subject on a computer, two-dimensional data is computed by performing rendering processing, and the data is displayed as a two-dimensional image.

When a person evaluates an object, he/she evaluates the object by picking it up and shaking it. That is, in general texture felt by a person, such as the glossy feeling of a subject, is obtained by changing the state of specular reflection of the subject through the changing of his/her viewpoint. Accordingly, in the case of the CG technique described above, it is required to repeatedly perform the rendering processing by dynamically changing specular reflection light through the slight changing of the direction in which the subject is illuminated. However, the processing amount of this rendering processing is large, so that there is a problem that an extremely long time is taken to perform the rendering processing.

Even if the processing speed of a computer is further improved in the future, it is still difficult to speedily create data about the shape of a subject and information about the texture thereof, which give a viewer real feeling, using the CG technique described above.

On the other hand, there is proposed a technique with which modeling of three-dimensional data having information about the texture of a subject is performed with a computer using images obtained by photographing the subject.

In JP 07-66436 B, JP 2001-108421 A, and the like, there is proposed a method with which three-dimensional data is obtained by taking a plurality of images from different viewpoints. With this method, however, specular reflection light and diffuse reflection light are not separated from each other, so that it is impossible to obtain sufficient information about the texture of a subject. Consequently, it is impossible to represent the texture of the subject as an image.

On the other hand, as a method of separating specular reflection light from diffuse reflection light for the sake of performing the three-dimensional modeling of a subject, there is proposed a method based on a dichroic reflection model (see "Extraction of Specular Reflection Using Multiple Color and Range Images", Ohtsuki et al., Journal of the Institute of Electronics, Information and Communication Engineers, D-II, vol. J-80-D-II, No.6, pp. 1352–1359, June 1997).

With this method, however, it is required to perform statistical processing for estimating a color vector, which leads to a necessity that the surface of the subject has a moderate size and a uniform texture. Consequently, in the case where the subject has a construction where different materials and colors are combined in a fine manner, it is difficult to apply the method described above to this subject. Accordingly, it is difficult to represent the texture of the subject as an image.

On the other hand, in JP 08-39841 A, there is proposed a method with which a subject is photographed to obtain images having different illumination directions, there are obtained a signal under a state where reflection light is large and a signal under a state where reflection light is small, whereby a glossiness signal representing the glossiness of the subject is obtained from these two signals, a gloss being given by an image forming means using this signal. With this method, however, the glossiness signal is obtained by subtracting the signal under the state where the reflection light is small from the signal under the state where the reflection light is large, so that it is impossible to represent the texture of a fiber fabric or the like whose glossiness has a directional property due to fine unevenness of the subject. Further, an image forming means gives a gloss through reheating during thermal transfer, so that it is impossible to finely control the texture of a subject because of the widening of heat generated by the reheating. Accordingly, there is a problem that it is impossible to sufficiently represent a fiber fabric or the feeling of grain.

SUMMARY OF THE INVENTION

Accordingly, in order to solve the problems described above, an object of the present invention is to provide an image recording method which is capable of representing the texture, such as the glossy feeling of the surface of a subject or the fine texture of a fiber fabric, on a recording medium such as recording paper.

Another object of the present invention is to provide an ink jet printer that carries out the image recording method.

In order to attain the object described above, the present invention provides an image recording method of recording an image of a still subject on a recording medium using a diffuse reflection image signal of the image representing the still subject under a state where illumination light is diffuse-reflected and a glossiness signal representing glossiness of the still subject, comprising a diffuse reflection image forming step of forming a diffuse reflection image of the still subject on the recording medium based on the diffuse reflection image signal, and a gloss adjusting step of forming a gloss adjustment layer made of a transparent gloss adjustment material in each region in units of pixels of the diffuse reflection image formed on the recording medium based on signal values of the glossiness signal.

Here, in addition to an image obtained with a camera or a scanner, the image representing a still subject under a state where illumination light is diffuse-reflected includes a computer graphic image that has been created by performing computation processing based on three-dimensional data, such as a specular reflectivity and a diffuse reflectivity, and which represents the still subject under a state where illumination light is diffuse-reflected.

Preferably, the diffuse reflection image forming step and the gloss adjusting step are performed by allowing droplets to be ejected onto the recording medium.

And, the gloss adjustment material is one of a gloss suppression material and a gloss material.

Further, preferably, the gloss adjustment layer is formed in each region corresponding to one pixel of the diffuse reflection image formed on the recording medium in accordance with a formation pattern that has a formation distribution of the gloss adjustment layer that varies in accordance with the signal values of the glossiness signal. Here, preferably, the formation pattern has a two-dimensional formation distribution of the gloss adjustment layer within each region of each pixel.

Preferably, the glossiness signal contains a first and second glossiness signals, the gloss adjustment layer is formed in each region in units of pixels of the diffuse reflection image in accordance with the first glossiness signal and the second glossiness signal, and when the formation of the gloss adjustment layer is performed in accordance with the first glossiness signal or the second glossiness signal, an inclination is given to the thickness of the gloss adjustment layer, with a direction of the inclination being different between the first glossiness signal and the second glossiness signal.

Preferably, the glossiness signal further contains a third glossiness signals, the gloss adjustment layer is formed in each region in units of pixels of the diffuse reflection image in accordance with the first glossiness signal, the second glossiness signal and the third glossiness signal, when the formation of the gloss adjustment layer is performed in accordance with the third glossiness signal, a thickness of the gloss adjustment layer is made constant, and when the formation of the gloss adjustment layer is performed in accordance with one of the first glossiness signal and the second glossiness signal, an inclination is given to the thickness of the gloss adjustment layer, with a direction of the inclination being different between the first glossiness signal and the second glossiness signal.

Preferably, the glossiness signal is generated based on the diffuse reflection image signal and specular reflection image signal of the still subject obtained through specular reflection of illumination light, and the diffuse reflection image signal and the specular reflection image signal are respective image signals of a scan-captured image obtained by capturing the whole of the still subject while relatively moving a capturing position with respect to the still subject.

Here, preferably, the diffuse reflection image signal is an image signal of a captured image of the still subject obtained by capturing diffuse reflection light in which a reflection direction of reflection light from the still subject placed on a plane-shaped base and illuminated is in a relationship of diffuse reflection with respect to an incident direction of illumination light onto the still subject and a plane of the plane-shaped base, and the specular reflection image signal is an image signal of a captured image of the still subject obtained by capturing specular reflection light in which a reflection direction of reflection light from the still subject placed on the plane-shaped base and illuminated is in a relationship of substantially specular reflection with respect to an incident direction of illumination light onto the still subject and the plane of the plane-shaped base.

The diffuse reflection image signal may be an image signal obtained by illuminating the still subject from two different directions at the same time or an image signal composed of a first diffuse reflection image signal and a second diffuse reflection image signal obtained by illuminating the still subject from two different directions at different times.

Preferably, if the diffuse reflection image signal is an image signal obtained by illuminating the still subject from two different directions at the same time, the illumination light used to obtain the diffuse reflection image signal contains more diffused light components than the illumination light used to obtain the specular reflection image signal, and a signal value of the glossiness signal is obtained by subtracting a conversion value obtained by color-converting a signal value of the diffuse reflection image signal from a conversion value obtained by color-converting a signal value of the specular reflection image signal.

Meanwhile, if the diffuse reflection image signal is composed of a first diffuse reflection image signal and a second diffuse reflection image signal obtained by illuminating the still subject from two different directions at different times, the illumination light used to obtain the diffuse reflection image signal preferably contains more diffused light components than the illumination light used to obtain the specular reflection image signal.

Here, preferably, the glossiness signal contains a first, second and third glossiness signals generated based on the diffuse reflection image signal and the specular reflection image signal, a specular reflection image signal conversion value, a first diffuse reflection image signal conversion value, and a second diffuse reflection image signal conversion value are respectively obtained by color-converting a signal value of the specular reflection image signal, a signal value of the first diffuse reflection image signal and a signal value of the second diffuse reflection image signal, if a first condition that the specular reflection image signal conversion value is equal to or greater than an average value of the first diffuse reflection image signal conversion value and the second diffused reflection image signal conversion value is satisfied, a difference obtained by subtracting the average value from the specular reflection image signal conversion value is set as a signal value of a third glossiness signal and signal values of first and second glossiness signals are set at zero, if the first condition is not satisfied and a second condition that the first diffuse reflection image signal conversion value is equal to or greater than the second diffuse reflection image signal conversion value is satisfied, a difference obtained by subtracting the specular reflection image signal conversion value from the first diffuse reflection image signal conversion value is set as the signal value of the second glossiness signal and the signal values of the first and third glossiness signals are set at zero, and if neither of the first condition nor the second condition is satisfied, a difference obtained by subtracting the specular reflection image signal conversion value from the second diffuse reflection image signal conversion value is set as the signal value of the first glossiness signal and the signal values of the second and third glossiness signals are set at zero.

Further, preferably, the gloss adjustment layer is formed in each region in units of pixels of the diffuse reflection image in accordance with the first glossiness signal, the second glossiness signal and the third glossiness signal, when the formation of the gloss adjustment layer is performed in accordance with the third glossiness signal, a thickness of the gloss adjustment layer is made constant, and when the formation of the gloss adjustment layer is performed in accordance with one of the first glossiness signal and the second glossiness signal, an inclination is given to the thickness of the gloss adjustment layer, with a direction of the inclination being different between the first glossiness signal and the second glossiness signal.

In addition, the present invention provides an ink jet printer that records an image by ejecting droplets using a diffuse reflection image signal of an image representing a still subject under a state where illumination light is diffuse reflected and a glossiness signal representing glossiness of the still subject, comprising an ink jet head that forms a diffuse reflection image on a recording medium by ejecting ink droplets based on a supplied control signal and ejects transparent gloss adjustment liquid onto each region in units of pixels of the diffuse reflection image based on a supplied adjustment signal, and a control circuit that generates the control signal for ejecting the ink droplets based on the diffuse reflection signal, generates the adjustment signal for adjusting the ejection of the gloss adjustment liquid based on the glossiness signal, and supplies the control signal and the adjustment signal to the ink jet head.

Here, in addition to an image obtained with a camera or a scanner, the image representing a still subject under a state where illumination light is diffuse-reflected includes a computer graphic image that has been created by performing computation processing based on three-dimensional data, such as a specular reflectivity and a diffuse reflectivity, and which represents the texture of a subject or the like.

BRIEF DESCRIPTION OF THE DRAWINGS

In the accompanying drawings:

FIGS. 4A and 4B each illustrate an example of a form of the ejection of a gloss adjustment liquid performed with the image recording method of the present invention;

FIGS. 5A to 5D each illustrate an example of the number of times the gloss adjustment liquid is ejected in accordance with the glossiness signal in the image recording method of the present invention;

DETAILED DESCRIPTION OF THE PRESENT INVENTION

Hereinafter, the image recording method and the ink jet printer of the present invention will be described in detail based on preferred embodiments shown in the accompanying drawings.

Figure 1A:
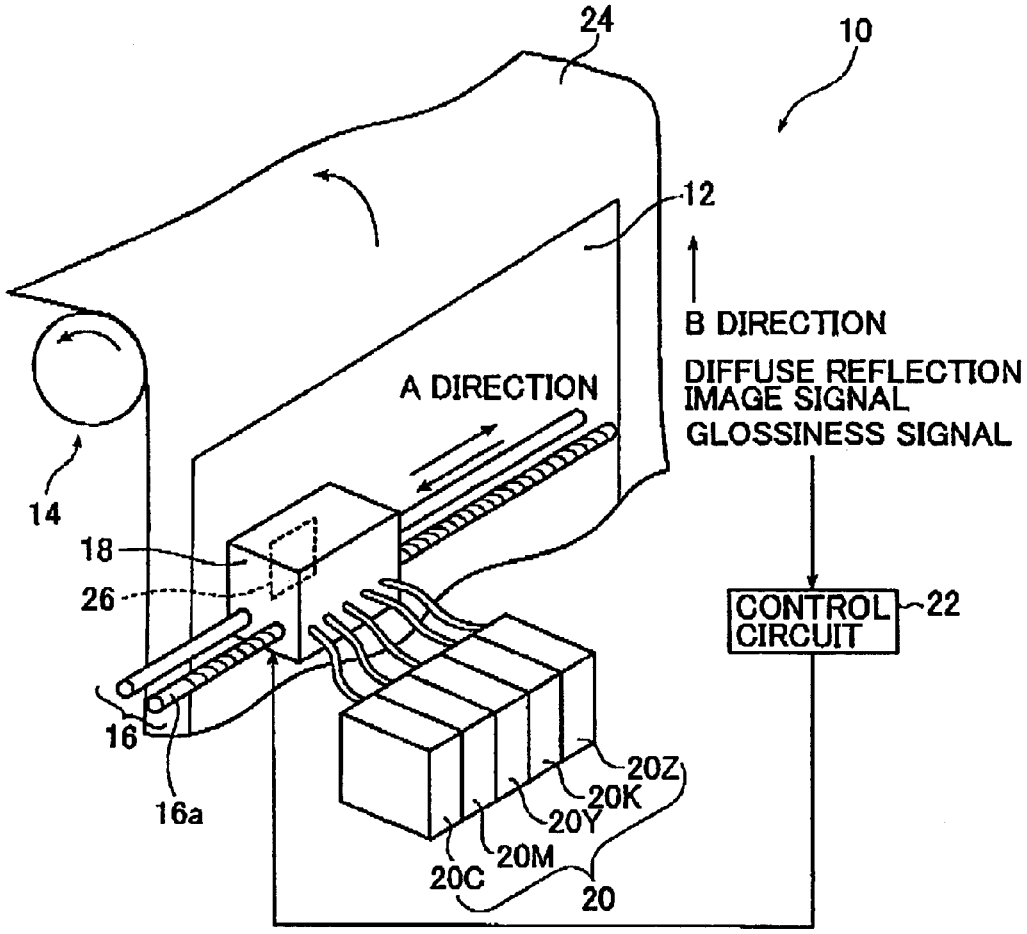
FIG. 1A is a construction diagram showing the schematic construction around an ink jet head in an embodiment of an ink jet printer of the present invention.
Figure 1B:
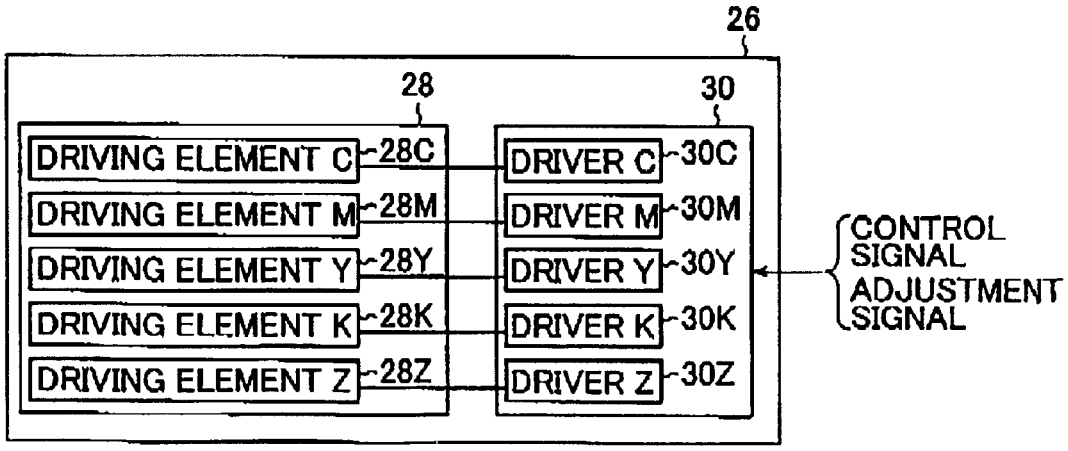
FIG. 1B is a block diagram showing the circuit construction around the ink jet head.

FIG. 1A is a construction diagram showing the schematic construction around an ink jet head in an embodiment of the ink jet printer of the present invention that carries out the image recording method of the present invention. Also, FIG. 1B is a block diagram showing the circuit construction around the ink jet head.

An ink jet printer 10 is a printer that records an image by ejecting droplets onto a recording medium 12, and mainly includes a conveying system 14 that conveys the recording medium 12, an ink jet head 18 that records an image by performing scanning in the width direction of the recording medium 12 using a moving mechanism 16, a reserve tank 20 for supplying ink liquid or the like to the ink jet head 18, and a control circuit 22 that generates a control signal and an adjustment signal for having the ink jet head 18 eject the droplets.

The ink jet head 18 is constructed so as to eject ink droplets at a dot density of 2400 dpi×1200 dpi, for instance. This ink jet head 18 also uses a publicly known error diffusion method and records an image at an effective resolution of around 300 dpi by performing area modulation based on dots.

It should be noted here that the arrow A direction in FIG. 1A will be hereinafter referred to as the "main scanning direction of the ink jet head".

The conveying system 14 conveys the recording medium 12 being fixed on a conveying belt 24 moved by a driving roller and various other rollers, in the arrow B direction in FIG. 1A at a constant speed. Note that the arrow B direction in FIG. 1A will be hereinafter referred to as the "conveying direction of the recording medium 12".

The ink jet head 18 is moved in the main scanning direction of the recording medium 12 by the rotation of a ball screw 16*a* and ejects droplets during this movement, thereby recording a desired image on the recording medium 12.

The reserve tank 20 includes reserve tanks 20C, 20M, 20Y, and 20K for reserving ink liquids in respective colors of cyan (C), magenta (M), yellow (Y), and black (K). In addition to these reserve tanks, the reserve tank 20 includes a reserve tank 20Z for reserving transparent gloss adjustment liquid. These reserve tanks are all connected to the ink jet head 18 and supply the ink liquids and the gloss adjustment liquid thereto. That is, the ink jet head 18 not only ejects ink droplets in respective colors of C, M, Y, and K but also ejects the gloss adjustment liquid as droplets.

Here, the gloss adjustment liquid is a solution that contains a gloss adjustment material as a solvent.

As to the gloss adjustment material, when glossy paper is used as the recording medium 12, a gloss suppression material for suppressing the gloss of the recording medium 12 is used as the solvent. On the other hand, when nonglossy paper such as mat paper is used as the recording medium 12, a gloss material for giving a gloss to the recording medium 12 is used as the solvent.

When a gloss should be suppressed, there is used latex or benzoguanamine resin, for instance. On the other hand, when a gloss should be given, there is used latex or the like, for instance.

When the latex is used to suppress a gloss, a droplet of the latex is first allowed to impinge on the recording medium 12 and then is subjected to air drying. By doing so, there is formed a gloss adjustment layer for suppressing the gloss.

On the other hand, when the latex is used to give a gloss, a droplet of the latex is first allowed to impinge on the recording medium 12 and then is subjected to heat treatment by a heat roller or the like. As a result of this heat treatment, in each portion on which the latex has impinged, there is formed a gloss adjustment layer whose glossiness is increased in accordance with the impingement amount of the latex.

On a surface of the ink jet head 18 that opposes the recording medium 12, there is provided a head chip 26. In this head chip 26, ink ejection nozzles that respectively correspond to the ink liquids and gloss adjustment liquid are provided so as to be opposed to the recording surface of the recording medium 12.

In the head chip 26, there are provided driving elements 28 (28C to 28Z) that respectively correspond to the ink ejection nozzles and realize the ejection of the ink liquids and the gloss adjustment liquid. In addition, there are provided driving circuits 30 (drivers 30C to 30Z) that respectively correspond to the driving elements 28C to 28Z.

Each driving element 28 may be a heating resistor that generates a bubble by boiling the ink or gloss adjustment liquid in accordance with an applied driving signal and achieves the ejection of a droplet using the expansive force of the bubble. Also, each driving element 28 may be a piezo element that changes the volume within a liquid chamber communicating with an ink ejection nozzle in accordance with a driving signal and realizes the ejection of a droplet from the ink ejection nozzle by utilizing this change in the volume. Further, each driving element 28 may be an ejection element of electrostatic type that changes the volume within the liquid chamber by changing a diaphragm using an electrostatic force and achieves the ejection of a droplet from an ink ejection nozzle by utilizing this change in the volume.

The control signal and the adjustment signal for achieving the droplet ejection are supplied from the control circuit 22, although these signals are generated in the driving circuits 30 from a diffuse reflection image signal and a glossiness signal supplied to the ink jet printer 10.

Here, the diffuse reflection image signal means an image signal of an image representing a still subject under a state where illumination light is irradiated and is diffuse-reflected by a surface. An example of such an image signal is an image signal captured from a substantially planar subject mounted on a planar base and illuminated which is obtained by capturing reflected light of the subject whose reflection direction is in a relationship of substantially diffuse reflection with respect to an incident direction of illumination light on the subject and a plane of the base. The relationship of diffuse reflection refers to a relationship in which the incident angle of illumination light on the plane of the base is not equal to the reflection angle of captured reflected light from the subject with respect to the plane of the base.

On the other hand, the glossiness signal is an image signal that represents the glossiness of a subject for each pixel of a captured image and is a signal constructed from two glossiness signal components in the main scanning direction and the conveying direction. Note that in the present invention, this glossiness signal may be a signal constructed from one glossiness signal component.

These diffuse reflection image signal and glossiness signal are generated with a method to be described later and are supplied from an image processing apparatus to be described later or the like. Alternatively, these signals are supplied as standardized image signals. For instance, the diffuse reflection image signal is a signal whose color signal components are C, M, and Y signals that are each an 8-bit signal, while the glossiness signal is a 2-bit signal that is represented by a Y component (luminance component) among YIQ color signal components.

The control circuit 22 generates a control signal for driving the drivers 30C to 30Y using the supplied diffuse reflection image signal and generates an adjustment signal for driving the driver 30Z using the supplied glossiness signal. Note that in the case where a text signal is supplied instead of the diffuse reflection image signal, the control circuit 22 generates a control signal for driving the driver 30K.

The ink jet printer 10 ejects ink in colors of C, M, Y, and K, although the present invention is not limited to this. The ink jet printer 10 may use ink in five colors including ink in light cyan and light magenta. Aside from this, the ink jet printer 10 may use ink in five or more colors.

In the ink jet printer 10 having the construction like this, first, the diffuse reflection image signal is supplied and the control signal is generated. Also, the glossiness signal is supplied and the adjustment signal is generated.

The control signal is supplied to the drivers 30C to 30Y and ink droplets are ejected by the driving elements 28C to 28Y. By doing so, a desired diffuse reflection image is formed.

Also, the adjustment signal is supplied to the driver 30Z and the ejection of the gloss adjustment liquid is adjusted by the driving element 28Z in units of pixels of the formed diffuse reflection image and the gloss adjustment liquid is ejected in each corresponding region on the recording medium 12. That is, the ejection of the gloss adjustment liquid onto the recording medium 12 is adjusted in units of pixels of the diffuse reflection image in accordance with the glossiness signal and the gloss adjustment liquid is ejected to the respective regions on the recording medium 12 corresponding to the units of pixels. In this manner, there is formed a gloss adjustment layer. Note that as to the units of pixels, it does not matter whether there is used units of one pixel or units of a plurality of pixels.

Here, a case where the ejection of the gloss adjustment liquid is adjusted in units of one pixel will be described in detail.

Figure 2:
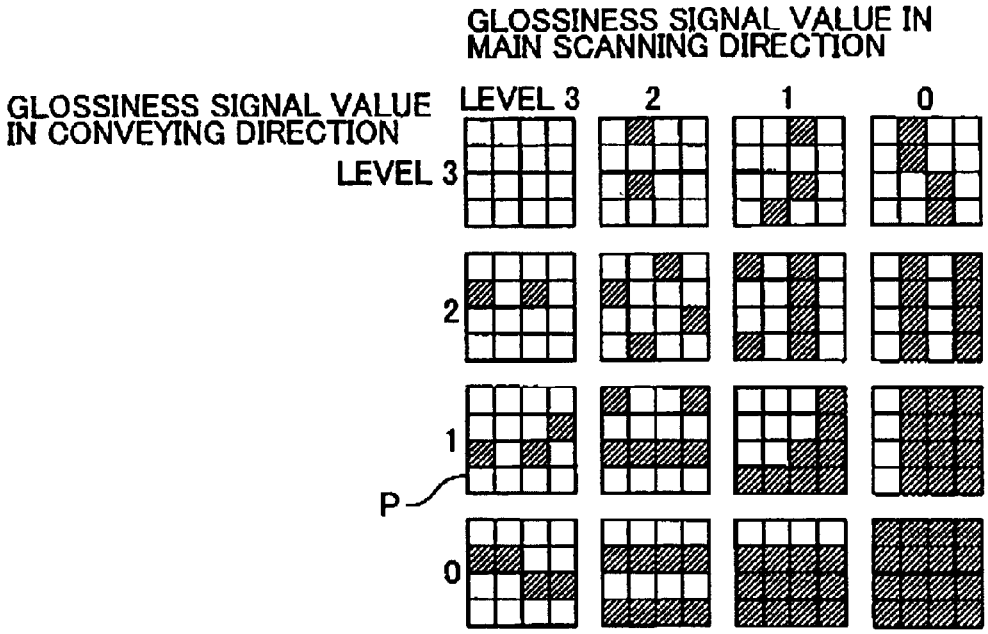
FIG. 2 illustrates a formation pattern of a gloss adjustment layer formed with the image recording method of the present invention.

FIG. 2 shows an example of a gloss adjustment layer formation pattern for forming the gloss adjustment layer by ejecting the gloss adjustment liquid in division regions obtained by dividing each pixel of the diffuse reflection image into 16 regions (four regions in the vertical direction× four regions in the horizontal direction). This formation pattern is a two-dimensional formation pattern that has a formation distribution of the gloss adjustment layer in two different directions within one pixel in accordance with a signal value of the glossiness signal.

For instance, it is assumed that an image is recorded on glossy paper, the signal value (at one of levels "0" to "3") of the 2-bit glossiness signal is at level 3 in the main scanning direction and is at level 3 in the conveying direction, and processing is performed to maximize the glossiness in both of the two directions. In this case, if gloss adjustment liquid containing a gloss suppression material is ejected onto a glossy recording medium like glossy paper, there is not performed the ejection of the gloss adjustment liquid. On the other hand, if the gloss adjustment liquid containing a gloss material is ejected onto a nonglossy recording medium like mat paper, the gloss adjustment liquid is ejected onto all of the division regions.

Next, it is assumed that the signal value of the glossiness signal is at level 0 in the main scanning direction and at level 0 in the conveying direction and processing is performed to suppress a gloss as much as possible. In this case, if gloss adjustment liquid containing a gloss suppression material is ejected onto a glossy recording medium like glossy paper, the gloss adjustment material is ejected onto all of the 16 division regions. On the other hand, if gloss adjustment liquid containing a gloss material is ejected onto nonglossy recording medium like mat paper, there is not performed the ejection of the gloss adjustment liquid.

Further, it is assumed that the signal value of the glossiness signal is at level 3 in the main scanning direction and is at level 1 in the conveying direction. In this case, the gloss adjustment liquid is ejected in accordance with the pattern P shown in FIG. 2 so that glossy paper is given a gloss as much as possible in the main scanning direction and a gloss in the conveying direction is almost removed. In FIG. 2, the diagonally shaded division regions are regions in which a gloss adjustment layer is formed using the gloss suppression material by ejecting the gloss adjustment liquid onto glossy paper. Also, the white division regions in FIG. 2 are regions in which a gloss adjustment layer is formed by ejecting the gloss adjustment liquid containing the gloss material onto a nonglossy recording medium such as mat paper.

Figure 3:
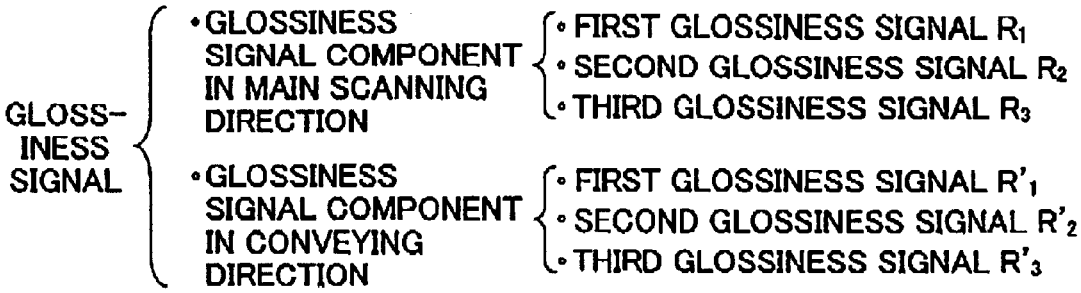
FIG. 3 illustrates a glossiness signal applied to the image recording method of the present invention.

The glossiness signal described above is a signal having glossiness signal components in two directions including the main scanning direction and the conveying direction. However, a subject that has a subtle slant due to fine unevenness of its surface may have a gloss with directional property. In the present invention, in order to reproduce the directional property of the gloss that occurs in accordance with this subtle slant of the subject surface, the first glossiness signals $R_1$ and $R_1'$, the second glossiness signals $R_2$ and $R_2'$, and the third glossiness signals $R_3$ and $R_3'$ are generated for glossiness signal components in two directions including the main scanning direction and the conveying direction with a method to be described later, which is as shown in FIG. 3.

It should be noted here that as can be seen from a method of generating the first to third glossiness signals $R_1$ to $R_3$ to be described later, there never occurs a case where any two signal values among the signal values of the first to third glossiness signals $R_1$ to $R_3$ in the glossiness signal component in the main scanning direction assume a value other than zero at the same time. The same applies to the first to third glossiness signals $R_1'$ to $R_3'$ in the conveying direction.

In the case where the first to third glossiness signals $R_1$ to $R_3$ and the first to third glossiness signals $R_1'$ to $R_3'$ are supplied to the ink jet printer 10 as the glossiness signal, in order to give a directional property to the gloss of an image of the subject to be recorded on the nonglossy recording medium 12 like mat paper, the gloss adjustment layer made-of the gloss material is given a thickness distribution inclined in a predetermined direction in accordance with the first glossiness signal $R_1$ to the third glossiness signal $R_3$ and the first to third glossiness signals $R_1'$ to $R_3'$. By doing so, it becomes possible to give a directional property in the specular reflection direction of an image formed from the subject.

In the case where the first glossiness signal $R_1$ to the third glossiness signal $R_3$ are each a 2-bit signal (at one of levels "0" to "3") and the signal value of the first glossiness signal $R_1$ is at level 3, for instance, the number of times the gloss adjustment liquid is ejected within one pixel is gradually changed from one to four as shown in FIG. 4A, thereby giving an inclination in one direction to the formation thickness of the gloss adjustment layer within one pixel. On the other hand, in the case where the signal value of the third glossiness signal $R_3$ is at level 3, the number of times the gloss adjustment liquid is ejected within one pixel is gradually changed from four to one as shown in FIG. 4B, thereby giving an inclination in a direction opposite to the inclination direction shown in FIG. 4A to the formation thickness of the gloss adjustment layer within one pixel.

In the case of the signal value of the second glossiness signal $R_2$, the number of times the gloss adjustment liquid is ejected is set as constant (two, for instance), thereby making the formation thickness of the gloss adjustment layer within one pixel constant.

It should be noted here that the ejection by the second glossiness signal $R_2$, the ejection by the first glossiness signal $R_1$, and the ejection by the third glossiness signal $R_3$ are each performed through different scan-movement of the ink jet head 18. That is, during the ejection of the gloss adjustment liquid, the ink jet head 18 scan-moves in order to perform the ejection three times. In more detail, there are performed the ejection by the first glossiness signal $R_1$, the ejection by the second glossiness signal $R_2$, and the ejection by the third glossiness signal $R_3$ at different times.

FIGS. 5A to 5D each illustrate an example of the distribution of the number of times the gloss adjustment liquid is ejected in correspondence with the first to third glossiness signals $R_1$ to $R_3$ in the main scanning direction and the first to third glossiness signals $R_1'$ to $R_3'$ in the conveying direction.

In the case where the signal value of the first glossiness signal $R_1$ in the main scanning direction is at level 3 and the signal value of the second glossiness signal $R_2$ in the conveying direction is at level 3, for instance, the number of times the gloss adjustment liquid is ejected is sequentially increased from one to four along the main scanning direction, as shown in FIG. 5A.

In the case where the signal value of the second glossiness signal $R_2$ in the main scanning direction is at level 3 and the signal value of the first glossiness signal $R_1'$ in the conveying direction is at level 3, the number of times the gloss adjustment liquid is ejected is sequentially decreased from four to one in the conveying direction, as shown in FIG. 5B.

On the other hand, in the case where the signal value of the first glossiness signal $R_1$ in the main scanning direction is at level 3 and the signal value of the first glossiness signal $R_1'$ in the conveying direction is at level 3, the number of times the gloss adjustment liquid is ejected in each division region becomes a rounded-off average number obtained from the numbers of times the gloss adjustment liquid is ejected in FIGS. 5A and 5B, which is shown in FIG. 5C.

Also, in the case where the signal value of the first glossiness signal $R_1$ in the main scanning direction is at level 3 and the signal value of the second glossiness signal $R_2'$ in the conveying direction is at level 1, the ejection of the gloss adjustment liquid containing the gloss material is not performed for division regions corresponding to the diagonally shaded portions in the pattern P shown in FIG. 2, thereby suppressing the gloss in these division regions. That is, in the division regions in FIG. 5D corresponding to the diagonally shaded areas in the pattern P shown in FIG. 2, the number of times the gloss adjustment liquid containing the gloss material is ejected is set at zero.

The number of times the gloss adjustment liquid is ejected is controlled by the adjustment signal supplied from the control circuit 22. However, in the case where the number of times the gloss adjustment liquid is ejected cannot be changed due to the limited ability of the ink jet printer 10, for instance, the control circuit 22 may create the adjustment signal described above using the maximum value or the average value of the signal values of the first to third glossiness signals $R_1$ to $R_3$ and the first to third glossiness signals $R_1'$ to $R_3'$ for the gloss having a directional property, thereby making constant the number of times the gloss adjustment liquid is ejected in the same division region. Further, in the case where the ink jet printer 10 can eject the gloss adjustment liquid using a formation pattern such as the one shown in FIG. 2, the control circuit 22 may create the adjustment signal described above using the maximum value or the average value of the signal values of the first to third glossiness signals $R_1$ to $R_3$ and the first to third glossiness signals $R_1'$ to $R_3'$ as the reference signal value of the glossiness signal for the gloss having no directional property.

As described above, the number of times the gloss adjustment liquid containing the gloss material is ejected is adjusted in accordance with the first to third glossiness signals $R_1$ to $R_3$ and $R_1'$ to $R_3'$ so that the transparent gloss adjustment layer formed on the recording medium 12 has a thickness distribution. By doing so, it becomes possible to reproduce a specular reflection state similar to that of an actual subject, whose surface has fine unevenness, and to reproduce the glossy feeling of the surface of a still subject and the texture of the still subject.

The ink jet printer 10 records an image using the diffuse reflection image signal and the glossiness signal of a still subject, as described above. These diffuse reflection image signal and glossiness signal are generated using a scanner and an image processing apparatus that will be described next.

Figure 6:
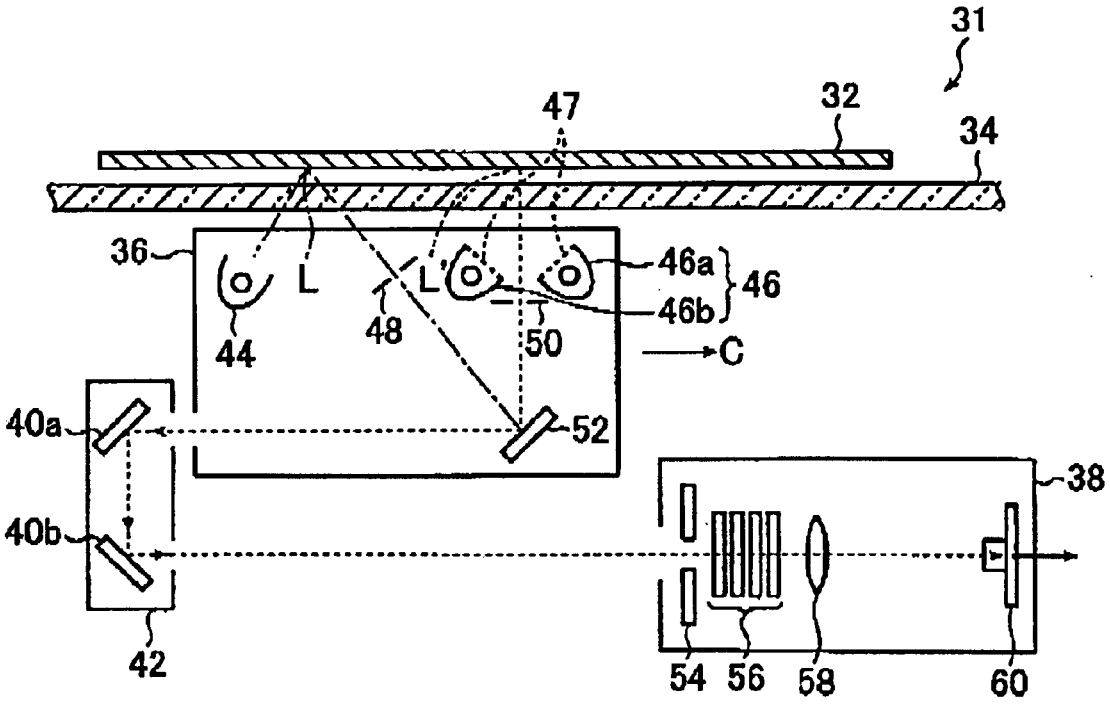
FIG. 6 illustrates the main part of a scanner that obtains the glossiness signal and a diffuse reflection image signal applied to the image recording method of the present invention.

FIG. 6 is a cross-sectional view of the main part of a scanner 31 that captures a subject in order to generate the diffuse reflection image signal and the glossiness signal with the image processing apparatus.

The scanner 31 has a planar glass base 34 on which a still subject 32 is mounted; an illumination unit 36 for illuminating the subject 32 in such a manner as to scan it in an arrow C direction; a capturing unit 38 for capturing reflected light from the subject 32 as obtained by the illumination unit 36; and a group of mirrors 42 consisting of mirrors 40*a* and 40*b* for guiding the reflected light from the illumination unit 36 to the capturing unit 38. A capturing surface of the subject 32 is directed to the surface side of the glass base 34.

The illumination unit 36 has a light source 44 extending in a vertical direction of a paper surface, which is arranged such that an incident direction of illumination light on the subject 32 in a capturing position L of the scanner 31 and a capturing direction in this capturing position L, are in a relationship of substantially specular reflection with respect to a plane of the glass base 34; a light source 46 extending in a vertical direction of a paper surface, which is arranged such that an incident direction of illumination light on the subject 32 in the capturing position L' of the scanner 31 and a capturing direction in a capturing position L' are in a relationship of diffuse reflection with respect to the plane of the glass base 34; slits 48 and 50 for regulating a position of reflected light from a subject; and a mirror 52 for guiding the reflected light whose position has been regulated by the slits 48 and 50 to the mirror 40*a*. Here, the relationship of substantially specular reflection refers to a relationship in which an incident angle of illumination light with respect to the plane of the base 34 is substantially equal to a reflection angle of reflected light from the subject in the scanner capturing position with respect to the plane of the base 34 (angle in the capturing position formed between the reflected light in the capturing direction and the plane). The relationship of diffuse reflection refers to a relationship in which the incident angle of illumination light is not equal to the reflection angle of reflected light from the subject in the scanner capturing position with respect to the plane of the base 34 (angle in the capturing position formed between the reflected light in the capturing direction and the plane).

Figure 7:
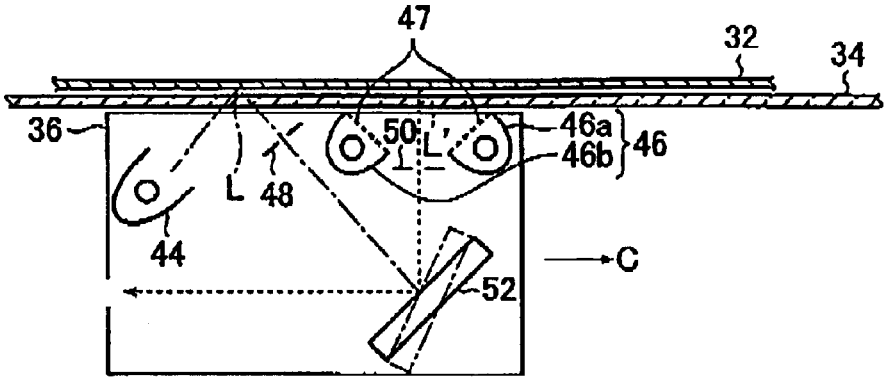
FIG. 7 illustrates an example of the capturing of a subject that is performed by the scanner shown in FIG. 6.

As shown in FIG. 7, the light source 46 consists of a light source 46*a* extending in the vertical direction of a paper surface and a light source 46*b* extending in the vertical direction of a paper surface, and is arranged so as to illuminate the subject 32 from two directions slanted in different directions with respect to the vertical direction of the plane of the glass base 34 at substantially an identical slant angle. In addition, both the light sources 46*a* and 46*b* are provided with diffusion plates 47 for diffusing illumination light. Illumination light of the light sources 46*a* and 46*b* contain more diffused light components compared with illumination light of the light source 44 that does not have the diffusion plate 47.

A position and a direction of a surface of the mirror 52 are arranged such that reflected light emitted from the light sources 46*a* and 46*b*, diffused and reflected by the subject 32 is captured in the vertical direction with respect to the plane of the glass base 34. Moreover, the direction of the surface of the mirror 52 can be adjusted freely such that reflected light from the subject 32 in the capturing position L is guided toward the mirror 40*a*.

The group of mirrors 42 is a part for guiding reflected light from the illumination unit 36 to the capturing unit 38 and is movable in the arrow C direction so as to allow position adjustment.

On the other hand, the capturing unit 38 has a stop 54 for stopping down an amount of reflected light, a group of filters 56 including color filters and an ND filter, a focusing lens 58 and a line CCD sensor 60.

The scanner 31 having such a structure is an apparatus for capturing reflected light from the illuminated subject 32 in the capturing positions L and L' while relatively moving the subject 32 and the capturing positions L and L' of the scanner 31. With the scanner 31, the light sources 44 and 46 are used separately to capture the subject 32, and an image by specular reflection light (hereinafter referred to as specular reflection image) is captured if the light source 44 is used to illuminate the subject 32, and an image by diffuse reflection light (hereinafter referred to as diffuse reflection image) is captured if the light source 46 is used to illuminate the subject 32.

Further, a position of the group of mirrors 42 with respect to the illumination unit 36 is adjusted such that an optical path of reflected light captured by the capturing unit 38 when the light source 44 is used to illuminate the subject 32 and an optical path of reflected light captured by the capturing unit 38 when the light source 46 is used to illuminate the subject 32 are substantially equal.

In addition, since the capturing position L for capturing the subject 32 using the light source 44 is different from the capturing position L' for capturing the subject 32 using the light source 46, it is necessary to perform positioning of the subject in the specular reflection image and the diffuse reflection image. This positioning is performed by image processing described below. For example, a distance between the capturing position L and the capturing position L' in the moving direction is determined in advance based on a set angle of the surface of the mirror 52, and pixel position correction of an image of the subject 32 is performed based on this distance. Alternatively, an uninterested area of the subject 32 may be marked so that pixel position correction of the subject in the specular reflection image and the diffuse reflection image can be performed with this mark as a reference.

In addition, the reference white plate (reference gray plate) with a high diffusivity is mounted on the glass base 34, data of an intensity distribution of reflected light is obtained and stored as shading correction data, and this shading correction data is used to apply shading correction (brightness correction) to the specular reflection image and the diffuse reflection image as image processing In capturing the reference white plate, since an intensity of specular reflection light made incident on the capturing unit 38 may be so strong as to exceed a light receiving tolerance of the line CCD sensor 60, the ND filter of the group of filters 56 may be used to perform intensity adjustment of the reflected light so that capturing of the reference white plate 20 and correction by the image processing described below can be performed.

The subject 32 that is substantially planar and has less unevenness of the surface is preferably used for capturing by the scanner 31. However, in the case of a subject having fine unevenness on its surface such as a woven fiber, an area on the subject where specular reflection is generated varies depending on a subtle slant of the surface of the subject.

Thus, as described below, fine unevenness of the subject is taken into account to separately illuminate the light sources 46*a* and 46*b* on the subject 32 and obtain different captured images.

Figure 8A:
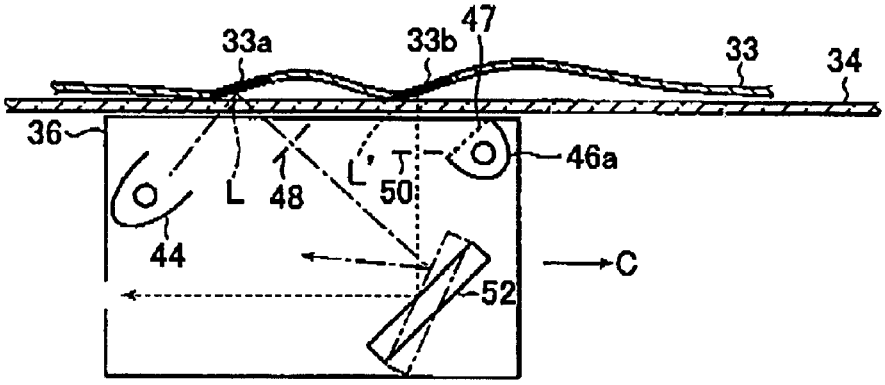
FIGS. 8A and 8B each illustrate another example of the capturing of the subject that is performed by the scanner shown in FIG. 6.
Figure 8B:
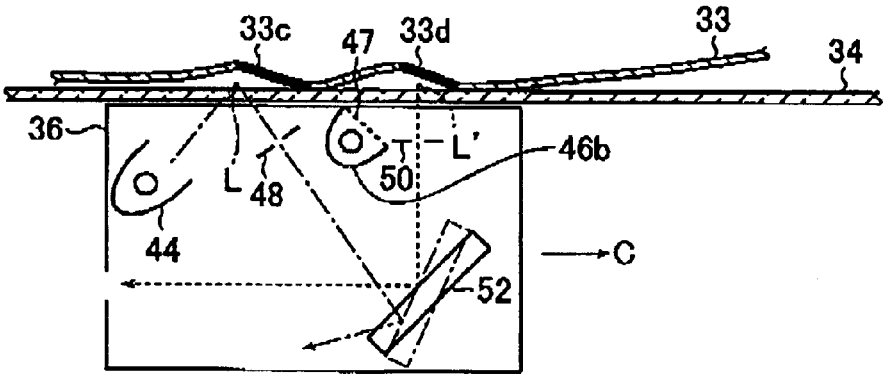

FIGS. 8A and 8B each show a relationship between a surface of a subject 33 having fine unevenness and reflected light. (Each of FIGS. 8A and 8B shows only one of light sources that illuminate a subject.)

If the surface of the subject 33 has no fine unevenness, specular reflection light is reflected in the capturing position L by the mirror 52 and the reflected light reaches via the group of mirrors 42 the capturing unit 38 where it is captured. However, as shown in FIG. 8A, if the subject 33 has unevenness with local slopes (upward slants to the right in FIG. 8A) 33*a* and 33*b*, since the surface of the subject in the capturing position L is slant, most of specular reflection light does not reach the capturing unit 38 in the state shown in FIG. 8A. The specular reflection light reflected on the local slope 33*a* shown in FIG. 8A is captured in the state of a high intensity in the capturing unit 38 only after the illumination unit 36 moves in the arrow C direction for a while from the state shown in FIG. 8A. Therefore, an intensity of the reflected light from the local slope 33*a* captured by the capturing unit 38 decreases in the state shown in FIG. 8A. On the other hand, if the surface of the subject 33 has no unevenness, diffuse reflection light from the light source 46*a* is captured in the capturing position L' by the capturing unit 38. However, since the surface of the subject in the capturing position L' is slant, an intensity of reflected light from the local slope 33*b* captured by the capturing unit 38 increases in the capturing position L' despite the fact that the light source 46*a* is provided with the diffusion plate 47 and the illumination light from the light source 46*a* has a lot of diffused light components.

As shown in FIG. 8B, in the case of local slopes (upward slants to the left in FIG. 8B) 33*c* and 33*d* whose slant direction is different from that of the local slopes 33*a* and 33*b*, an intensity of reflected light from the local slope 33*c* captured by the capturing unit 38 decreases in the capturing position L. In this case, specular reflection light with a high intensity is captured by the capturing unit 38 in a state prior to the state shown in FIG. 8B. On the other hand, an intensity of reflected light from the local slope 33*d* captured by the capturing unit 38 increases in the capturing position L'.

In this way, as is seen from FIGS. 8A and 8B, intensities of specular reflection light and diffuse reflection light that are captured in the capturing positions change depending on a slant of a subject. In order to cope with such a change, in image processing described below, a diffuse reflection image obtained by lighting the light source 46*a* and the light source 46*b* separately and a specular reflection image obtained by using the light source 44 are used to generate a glossiness signal with directional property.

Figure 9:
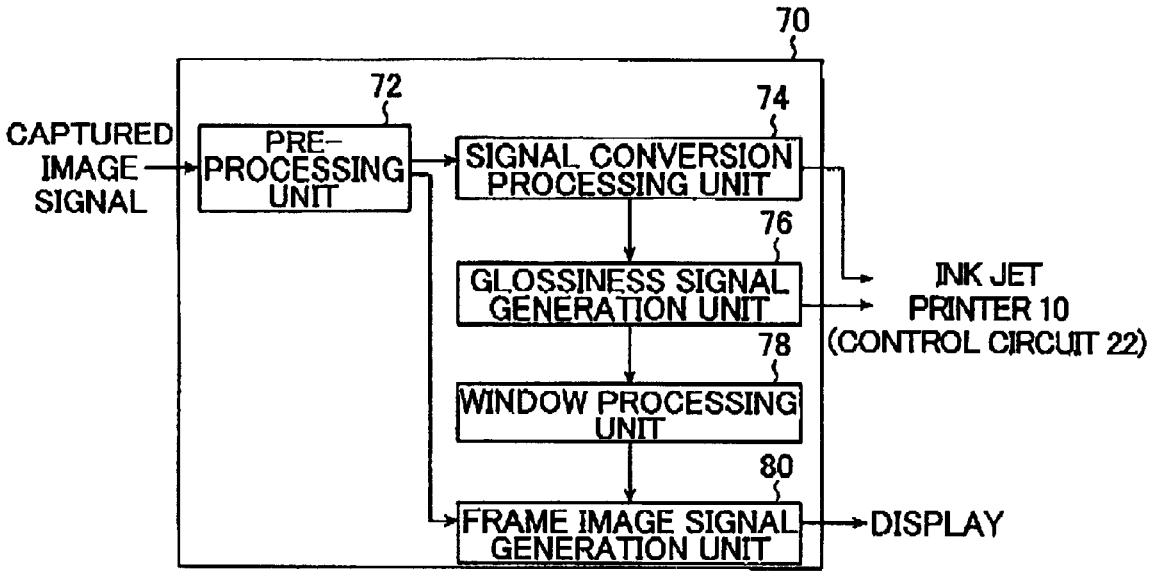
FIG. 9 is a block diagram showing a construction of an exemplary image processing apparatus that generates the glossiness signal and the diffuse reflection image signal applied to the image recording method of the present invention.

Such capturing of a subject is performed by the scanner 31, and one specular reflection image and one or two diffuse reflection images are obtained and sent to an image processing apparatus 70 shown in FIG. 9.

Further, with the scanner 31, since the light sources 44 and 46 extend in the vertical direction of the paper surface, only information in one direction (horizontal direction of the paper surface in FIG. 6) is obtained as information of specular reflection light. Therefore, if information of specular reflection of a subject is obtained in a two-dimensional form to produce a glossiness signal corresponding to glossiness signal components in two directions including main scanning direction and conveying direction in the ink jet printer 10, it is preferable to rotate a subject to be mounted on the glass base 34 by 90 degrees and capture a specular reflection image by the above-mentioned method.

Since processing in the case in which specular reflection images in two directions are captured is performed in the same method as processing described below, the case in which a specular reflection image in one direction is captured will be hereinafter described.

The image processing apparatus 70 shown in FIG. 9 is an apparatus that generates a glossiness signal using captured image signals of a specular reflection image and diffuse reflection images supplied from the scanner 31, that is, using a specular reflection image signal and diffuse reflection image signals, supplies the diffuse reflection image signals and the glossiness signal to the control circuit 22 of the ink jet printer 10, and creates a frame image for displaying an image on a display as necessary.

Figure 10:
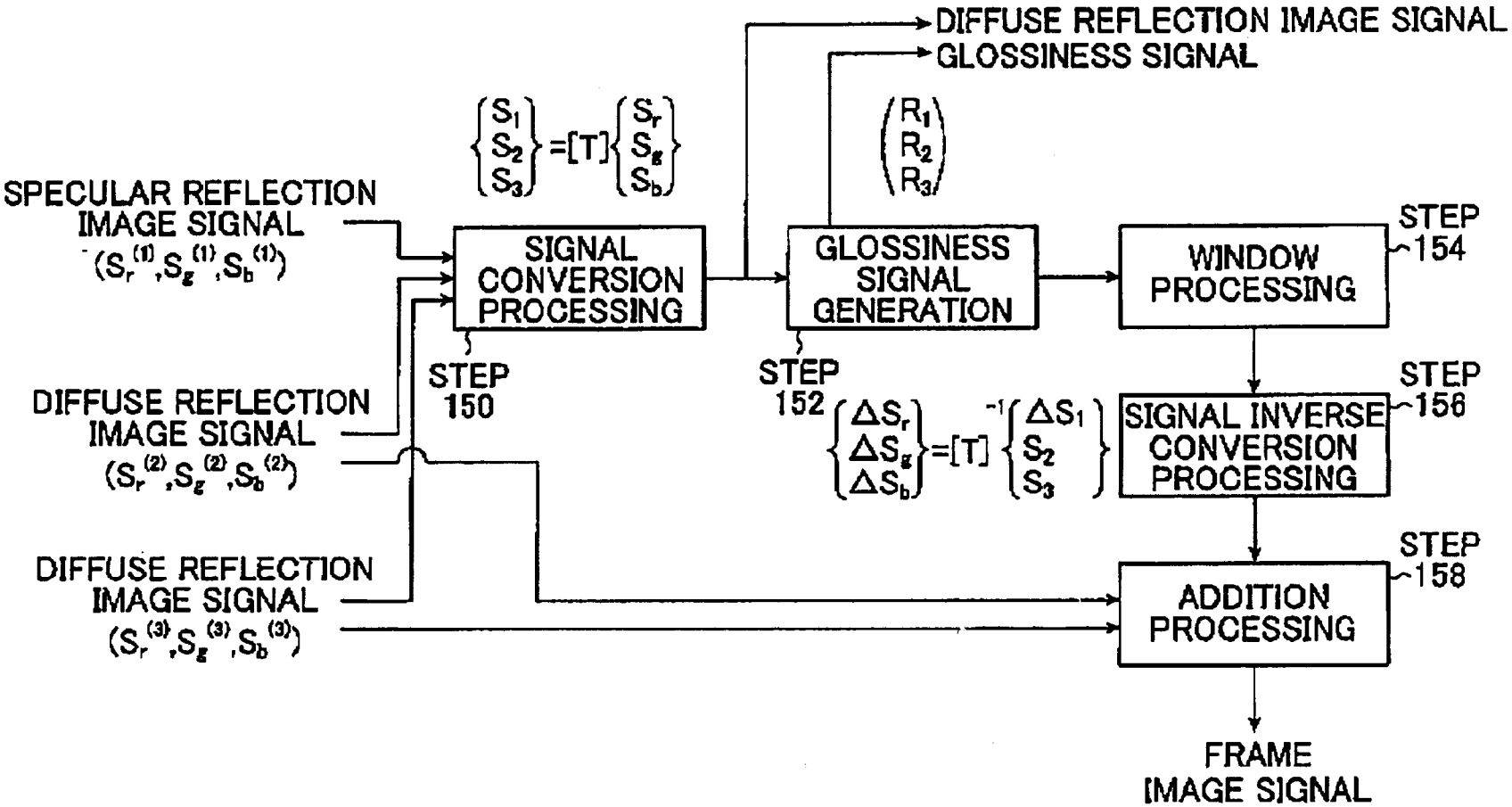
FIG. 10 is a flowchart showing a flow for generating the glossiness signal and the diffuse reflection image signal applied to the image recording method of the present invention.

FIG. 10 shows processing steps carried out by the image processing apparatus 70. The processing steps include signal conversion processing (step 150), generation of a glossiness signal (step 152), window processing (step 154) performed as required, signal inverse conversion processing (step 156) and addition processing (step 158).

The image processing apparatus 70 is an apparatus having a pre-processing unit 72, a signal conversion processing unit 74, a glossiness signal generation unit 76, a window processing unit 78 and a frame image signal generation unit 80. The image processing apparatus 70 may be a dedicated apparatus in which each part is constituted by a circuit or may be constituted by a computer for starting up software to cause each part to perform the best of its function.

The pre-processing unit 72 subjects a captured image signal to known processing such as pixel position correction and shading correction of the subject, and defect correction, dark current correction and γ correction based on the line CCD sensor 60.

The processed captured image signal is sent to the signal conversion processing unit 74 and the frame image signal generation unit 80.

If the captured image signal consists of an R signal, a G signal and a S signal, the signal conversion processing unit 74 converts (color-converts) a signal value $S_r$ of the R signal, a signal value $S_g$ of the G signal and a signal value $S_b$ of the B signal into signal conversion values $S_1$, $S_2$ and $S_3$ by a conversion matrix T, for example, to color signal values of an Y component, an I component and a Q component. That is, the signal conversion processing unit 74 performs the processing of step 150 shown in FIG. 10.

Further, of the captured image signals, the signal conversion processing unit 74 color-converts a diffuse reflection image signal composed of R, G, and B signals into a diffuse reflection image signal composed of C, M, and Y signals, which is then supplied to the control circuit 22 of the ink jet printer 10.

Here, it signal values $S_r^{(1)}$, $S_g^{(1)}$ and $S_b^{(1)}$ of a specular reflection image signal, two kinds of signal values of diffuse reflection image signals $S_r^{(2)}$, $S_g^{(2)}$ and $S_b^{(2)}$ (image signals of a diffuse reflection image that is captured by using the light source 46*a* shown in FIG. 8A) and $S_r^{(3)}$, $S_g^{(3)}$ and $S_b^{(3)}$ (image signals of a diffuse reflection image that is captured by using the light source 46*b* shown in FIG. 8B) are supplied, the signal conversion processing unit 74 applies conversion to each of the supplied image signals.

The conversion matrix T is a matrix that is decided depending on with which color signal components a glossiness signal described below is generated. For example, if a glossiness signal is generated with a luminance component (Y component), the conversion matrix T becomes a known conversion matrix of Y, I and Q components and R, G and B signals. Further, in a glossiness signal, it is preferable to decide color signal components to be set depending on, for example, a spectral intensity characteristic of illumination light from the light source 44 and the light source 46 in the scanner 31 and a color tint of a subject. The signal conversion values $S_1$, $S_2$ and $S_3$ for each pixel of the captured image are sent to the glossiness signal generation unit 76.

The glossiness signal generation unit 76 is a part for extracting a signal conversion value of a color signal component of interest, for example, an Y component (luminance component) in the case of Y, I and Q components, from the signal conversion values $S_1$, $S_2$ and $S_3$, and applying the following processing to the signal conversion value to generate a glossiness signal (step 152 in FIG. 10). Note that the signal conversion value of the color signal component of interest is set as a signal conversion value $S_1$.

Figure 11:
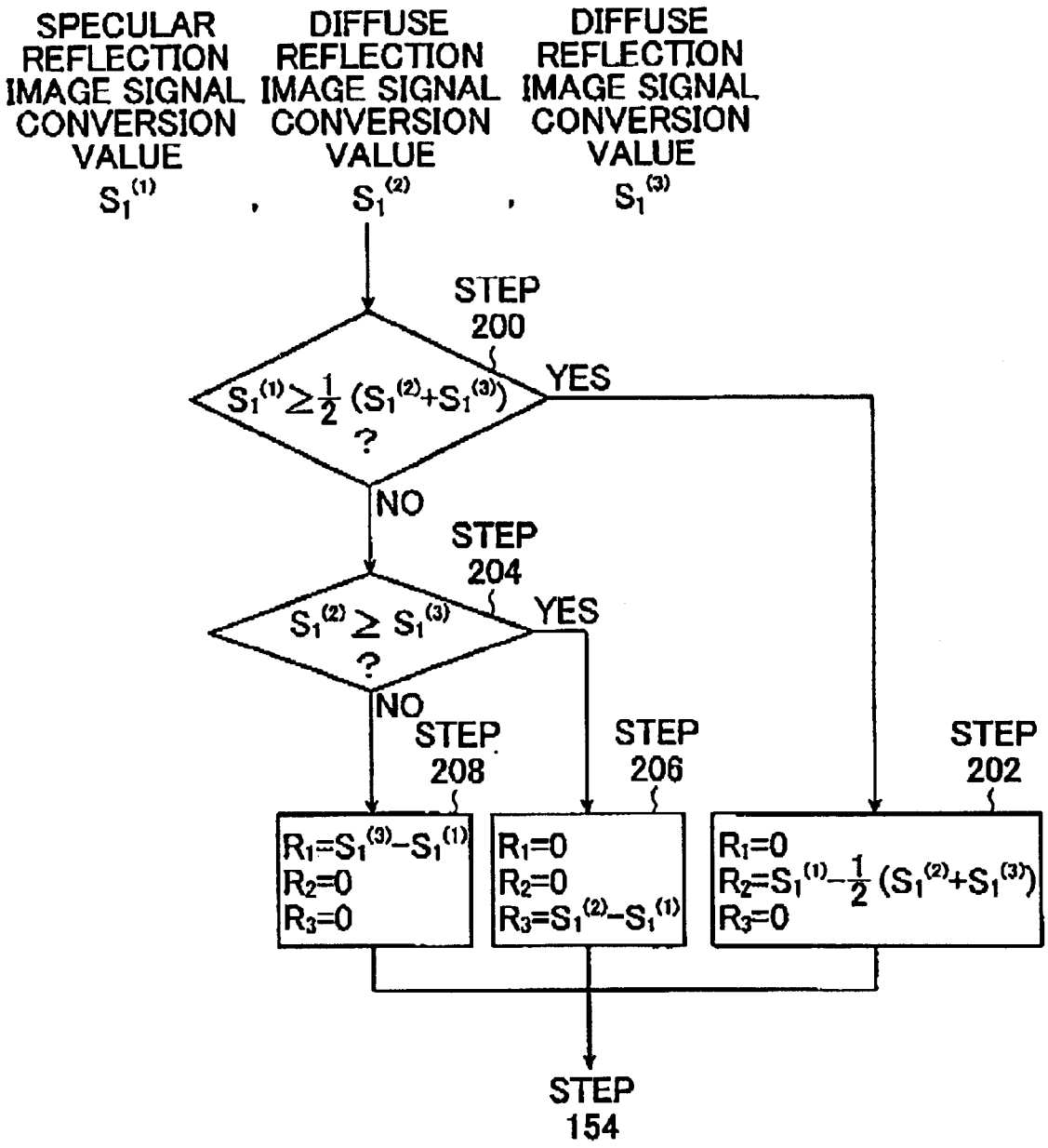
FIG. 11 is a flowchart showing a flow of the main portion of the flow shown in FIG. 10.

Assuming that a signal conversion value of a color signal component of interest in a specular reflection image (signal conversion value of a specular reflection image) is $S_1^{(1)}$, signal conversion values of color signal components of interest in two diffuse reflection images (signal conversion values of diffuse reflection images) are $S_1^{(2)}$ and $S_1^{(3)}$, these signal conversion values are processed in accordance with a flow shown in FIG. 11.

The signal conversion values $S_1^{(1)}$, $S_1^{(2)}$ and $S_1^{(3)}$ are compared for each identical pixel position on the captured image (step 200). If the signal conversion value $S_1^{(1)}$ is equal to or more than an average value of the signal conversion values $S_1^{(2)}$ and $S_1^{(3)}$, signal values of a first glossiness signal $R_1$ and a third glossiness signal $R_3$ are set at zero, and a signal value of a second glossiness signal $R_2$ is set at a difference obtained by subtracting the average value of the signal conversion values $S_1^{(2)}$ and $S_1^{(3)}$ from the signal conversion value $S_1^{(1)}$ (step 202).

Further, if a specular reflection image is obtained by capturing specular reflection light with a high intensity and a diffuse reflection image is obtained by capturing diffuse reflection light with a low intensity, the condition that the signal conversion value $S_1^{(1)}$ is equal to or more than the average value of the signal conversion values $S_1^{(2)}$ and $S_1^{(3)}$ is satisfied in step 200.

Next, if the condition in step 200 is not satisfied, the signal conversion values $S_1^{(2)}$ and $S_1^{(3)}$ are compared (step 204). That is, if the signal conversion value $s_1^{(2)}$ is equal to or more than the signal conversion value $S_1^{(3)}$, the signal values of the first glossiness signal $R_1$ and the second glossiness signal $R_2$ are set at zero, and the signal value of the third glossiness signal $R_3$ is set at a difference obtained by subtracting the signal conversion value $S_1^{(1)}$ from the signal conversion value $S_1^{(2)}$ (step 206).

Further, if strong diffuse reflection light is captured when the light source 46*a* is used to illuminate the subject 33 as shown in FIG. 8A, that is, if the local slope 33*b* of the subject 33 is captured, the condition in step 204 that the signal conversion value $S_1^{(2)}$ is equal to or more than the signal conversion value $S_1^{(3)}$ is satisfied.

If the condition in step 204 is not satisfied, that is, if the signal conversion value $S_1^{(2)}$ is smaller than the signal conversion value $S_1^{(3)}$, the signal values of the second glossiness signal $R_2$ and the third glossiness signal $R_3$ are set at zero, and the signal value of the first glossiness signal $R_1$ is set at a difference obtained by subtracting the signal conversion value $S_1^{(1)}$ from the signal conversion value $S_1^{(3)}$ (step 208).

Further, the state in which the signal conversion value $S_1^{(2)}$ is smaller than the signal conversion value $S_1^{(3)}$ occurs if strong diffuse reflection light is captured when the light source 46*b* is used to illuminate the subject 33 as shown in FIG. 8(*b*), that is, if the local slope 33*d* of the subject 33 is captured.

In this way, the glossiness signals (the first glossiness signal $R_1$ to the third glossiness signal $R_3$) are generated for the color signal component of interest.

On the other hand, if one diffuse reflection image is captured by lighting the light sources 46*a* and 46*b* simultaneously as shown in FIG. 7, in the signal conversion processing unit 74, signal values $S_r^{(1)}$, $S_g^{(1)}$ and $S_b^{(1)}$ of a specular reflection image signal and signal values of one diffuse reflection image signal (these signal values of the diffuse reflection image signal are assumed to be $S_r^{(4)}$, $S_g^{(4)}$ and $S_b^{(4)}$) are converted to obtain signal conversion values (these signal conversion values are assumed to be $S_1^{(1)}$ and $S_1^{(4)}$) of color signal component of interest. In the glossiness signal generation unit 76, a difference obtained by subtracting the signal conversion value $S_1^{(4)}$ of a diffuse reflection image of interest from the signal conversion value $S_1^{(1)}$ of a specular reflection image of interest is determined, and this difference is set as a signal value of a glossiness signal.

In this case, as shown in FIG. 7, since the subject 32 is substantially planar, the signal conversion value $S_1^{(1)}$ is larger than the signal conversion value $S_1^{(4)}$.

The generated glossiness signal is supplied from the glossiness signal generation unit 76 to the control circuit 22 of the ink jet printer 10 along with the diffuse reflection image signals supplied from the signal conversion processing unit 74 to the control circuit 22 of the ink jet printer 10.

The glossiness signal generated in the example described above is a one-dimensional glossiness signal in a direction in which the scanner 31 performed capturing through scanning. As described above, however, in the case where the subject placed on the glass base 34 is rotated by 90° to capture a specular reflection image, a two-dimensional glossiness signal corresponding to glossiness signal components in two directions including the main scanning direction and the conveying direction in the ink jet printer 10 is generated using a specular reflection image signal obtained by scan-capturing in two directions and the two-dimensional glossiness signal is supplied to the control circuit 22 along with the diffuse reflection image signals.

Further, as necessary, the glossiness signal is sent as required to the window processing unit 78 in order to create a frame image to be displayed on a display.

Figure 12:
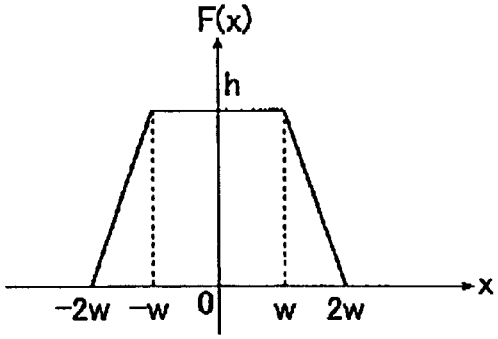
FIG. 12 illustrates a window function used in the flow shown in FIG. 10.

The window processing unit 78 is a part for moving a central position of a window function F shown in FIG. 12 to a selected position, and multiplying a signal value of a corresponding glossiness signal by a value of the window function F every time the central position of the window function F is moved, that is, for performing window processing (step 154 in FIG. 10). When it is assumed that a direction in which information of specular reflection is obtained in the scanner 31, that is, a scan capturing direction is an x direction, the window function F has a distribution of a trapezoid shape with a width of the base of 4 w, a width of the upper side of 2 w and a height of h in this x direction.

Figure 13A:
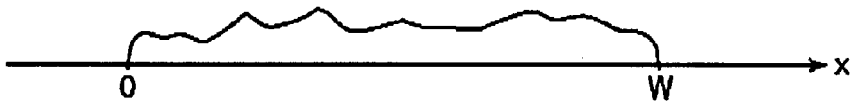
FIGS. 13A to 13E each illustrate window processing performed in the flow shown in FIG. 10.
Figure 13B:
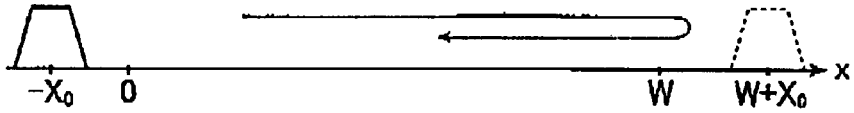

Such a window function F has window functions $F_1$, $F_2$ and $F_3$ in association with the first glossiness signal $R_1$, the second glossiness signal $R_2$ and the third glossiness signal $R_3$. If it is assumed that the number of pixels of a horizontal width (image width) of a captured image such as a diffuse reflection image or a specular reflection image is W as shown in FIG. 13A, a central position of the window function $F_2$ moves in a range of $-X_0$ to $W+X_0$ and moves back and forth in a range of $-X_0$ to $W+X_0$ with an amount of one movement as $(W+2\cdot X_0)/N$ $(=\alpha)$ as shown in FIG. 13B. That is, since the number of pixels of a horizontal width (image width) of a glossy image of a subject represented by the glossiness signals of the first glossiness signal $R_1$, the second glossiness signal $R_2$ and the third glossiness signal $R_3$ is W, the central position of the window function $F_2$ moves back and forth in a range of $-X_0$ to $W+X_0$ with an amount of one movement as $(W+2\cdot X_0)/N$ $(-\alpha)$ based on a pixel arrangement of the glossy image as shown in FIG. 13D. Here, $X_0$ is a parameter representing a movement starting position of a window function F(x) and the number of pixels of a predetermined width defining a return position. That is, the movement starting position is a position $X_0$ apart from one image end to the outside in the moving direction of the captured image, and the return position is a position $X_0$ apart from the other image end to the outside in the moving direction of the captured image. This parameter is set by an operator, or a parameter set in advance is used. In addition, N is a number that is a half of the number of frame images in displaying a subject on a display as described below. In this way, the window function $F_2$ moves to a plurality of moving positions, an interval of which is defined by the above-mentioned $\alpha$.

Figure 13C:
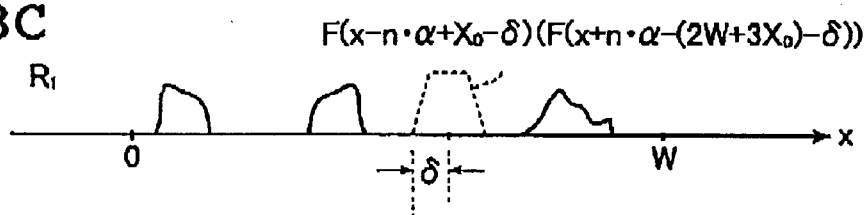
Figure 13D:
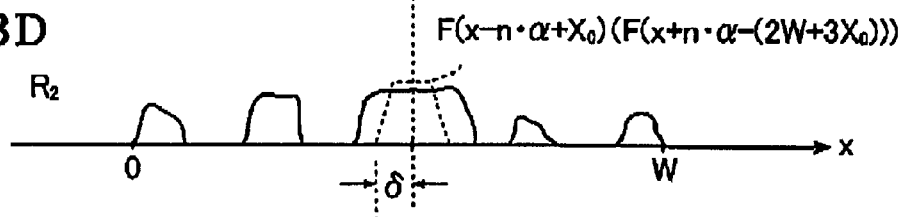
Figure 13E:
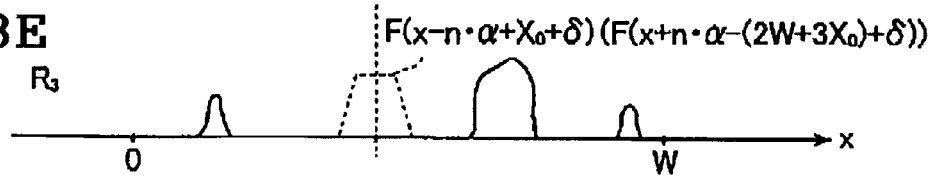

Central positions of the window functions $F_1$ and $F_3$ move simultaneously with the window function $F_2$; the window function $F_1$ moves forward in the moving direction and the window function $F_3$ moves backward in the moving direction while being apart from each other by the number of pixels $\delta$ equivalent to a predetermined distance with the window function $F_2$ corresponding to the second glossiness signal $R_2$ as a reference as shown in FIGS. 13C and 13E. Here, the number of pixels $\delta$ is set by an operator, or is a parameter set in advance. As described concerning the capturing of a subject, this number of pixels $\delta$ is a parameter that is provided in association with a change in an intensity of specular reflection light of a subject according to a slant of fine unevenness of a subject surface. This parameter is used for reproducing the texture such as glossiness of a subject including information on fine unevenness of the subject surface, and set by an operator or set in advance. Consequently, directional property can be given to specular reflection and glossiness of the subject.

Specifically, the window processing is for multiplying a second glossiness signal $R_2$ (x) (x is a coordinate value with a position of one end of a captured image in an x direction that is a scan capturing direction as x=0) by the window function $F_2=F(x-n\cdot\alpha+X_0)$ (forward path in the range of $-X_0$ to $W+X_0$), multiplying a first glossiness signal $R_1$ (x) by the window function $F_1=F(x-n\cdot\alpha+X_0-\delta)$ located before the window function $F_2$ in the moving direction, and multiplying a third glossiness signal $R_3$ (x) by the window function $F_3=F(x-n\cdot\alpha+X_0+\delta)$ located behind the window function $F_2$ in the moving direction.

Further, the above-mentioned window functions $F_1=F(x-n\cdot\alpha+X_0-\delta)$, $F_2=F(x-n\cdot\alpha+X_0)$ and $F_3=F(x-n\cdot\alpha+X_0+\delta)$ are functions in the case of movement on the forward path in the x direction. In the case of movement on the backward path, the window function $F_1$ is $F(x+n\cdot\alpha-(2\cdot W+3\cdot X_0)-\delta)$, the window function $F_2$ is $F(x+n\cdot\alpha-(2\cdot W+3\cdot X_0))$ and the window function $F_3$ is $F(x+n\cdot\alpha-(2\cdot W+3\cdot X_0)+\delta)$. Here, n is an order from the movement starting position, which indicates an order of a frame image described below, and is an integer of 0 to $2\cdot N-1$. In the case of n=0 to N, movement of the window function corresponds to the forward path, and in the case of n=N+1 and subsequent numbers, corresponds to the backward path.

In this way, multiplication results in accordance with the movement of the window functions $F_1$, $F_2$ and $F_3$, that is, fluctuating according to n are obtained and sent to the frame image signal generation unit 80.

In the frame image signal generation unit 80, the multiplication results calculated in the window processing unit 78 are added to obtain a glossiness fluctuation component $\Delta S_1$. Inverse conversion of the conversion by the above-mentioned conversion matrix T is applied to this glossiness fluctuation component $\Delta S_1$ to obtain inverse conversion values $\Delta S_r$, $\Delta S_g$ and $\Delta S_b$ corresponding to the R signal, the G signal and the a signal (step 156 in FIG. 10). Thereafter, an average value $\frac{1}{2}\cdot(S_r^{(2)}+S_r^{(3)})$ of the R signal, an average value $\frac{1}{2}\cdot(S_g^{(2)}+S_g^{(3)})$ of the G signal, and an average value $\frac{1}{2}\cdot(S_b^{(2)}+S_b^{(3)})$ of the B signal of two kinds of diffuse reflection image signals $S_r^{(2)}$, $S_g^{(2)}$ and $S_b^{(2)}$ and $S_r^{(3)}$, $S_g^{(3)}$ and $S_b^{(3)}$ are added to these inverse conversion values $\Delta S_r$, $\Delta S_g$ and $\Delta S_b$, respectively (step 158 in FIG. 10), and frame image signals of 0 to $2\cdot N-1$ sequenced by n are generated.

The obtained frame image signals are sequentially supplied to a display as frame images of subjects of 0 to $2\cdot N-1$ (frame images of n=1 to N−1 become frame images in the case of the forward path of the window functions and becomes frame images in the case of the backward path of the window functions) at a fixed time interval in the order of frame images, that is, in the order of n. Then, switching of the sequenced frames images is performed 2·N−1 times or more on the display, that is, at least one back and forth movement of the window functions $F_1$, $F_2$ and $F_3$ is performed, and a reflection area of the subject in the images is shown on the display so as to fluctuate temporally.

The above-mentioned example explains the case in which the specular reflection image signals $S_r^{(1)}$, $S_g^{(1)}$ and $S_b^{(1)}$, the two kinds of diffuse reflection image signals $S_r^{(2)}$, $S_g^{(2)}$ and $S_b^{(2)}$ and $S_r^{(3)}$, $S_g^{(3)}$ and $S_b^{(3)}$ are supplied as captured image signals. Here, the case will be described in which the light sources 46*a* and 46*b* are simultaneously illuminated on the subject 32 in the scanner 31 as shown in FIG. 7, that is, the specular reflection image signals $S_r^{(1)}$, $S_g^{(1)}$ and $S_b^{(1)}$ and one kind of diffuse reflection image signals $S_r^{(4)}$, $S_g^{(4)}$ and $S_b^{(4)}$ are supplied to the image processing apparatus 70 as captured image signals.

In this case, as in the processing shown in FIG. 10, signal conversion processing (step 150), generation of a glossiness signal (step 152), window processing (step 154), signal inverse conversion processing (step 156) and addition processing (step 158) are performed. During the signal conversion processing, a diffuse reflection image signal composed of R, G, and B signals is converted into a diffuse reflection image signal composed of C, M, and Y signals, which is then supplied to the control circuit 22 of the ink jet printer 10.

In the signal conversion processing, the specular reflection image signals $S_r^{(1)}$, $S_g^{(1)}$ and $S_b^{(1)}$ are subjected to signal conversion by the above-mentioned conversion matrix T, and a signal conversion value $S_1^{(1)}$ of a color signal component of interest is extracted out of three components of signal conversion values. Similarly, the same processing is applied to the diffuse reflection image signals $S_r^{(4)}$, $S_g^{(4)}$ and $S_b^{(4)}$, and a signal conversion value $S_1^{(4)}$ is extracted.

Next, a glossiness signal R is obtained in accordance with the following expression:

$$R=S_1^{(1)}-S_1^{(4)}$$

This glossiness signal is supplied to the control circuit 22 of the ink jet printer 10.

In the window processing that is performed as necessary, window functions $F_4=F(x-n\cdot\alpha+X_0)$ (forward path) and $F(x+n\cdot\alpha-(2\cdot W+3\cdot X_0))$ (backward path) are used, which move on an image in the same manner as the above-mentioned window function $F_2$. Then, a value of the window function $F_4$ is multiplied by a value of the corresponding glossiness signal R.

In the signal inverse conversion processing, the above-mentioned multiplication result is assumed to a glossiness fluctuation component $\Delta S_1$, to which inverse conversion of the conversion by the above-mentioned conversion matrix T is applied, and inverse conversion values $\Delta S_r$, $\Delta S_g$ and $\Delta S_b$ corresponding to an R signal, a G signal and a B signal are obtained Then, components of the diffuse reflection image signals $S_r^{(4)}$, $S_g^{(4)}$ and $S_b^{(4)}$ are added to the inverse conversion values $\Delta S_r$, $\Delta S_g$ and $\Delta S_b$, respectively (step 158 in FIG. 10), and frame image signal values sequenced by n are generated. The generated frame image signals are sequentially supplied to the display at a fixed time interval according to the order of n.

In this manner, a glossiness signal representing the texture such as glossy feeling of a subject is supplied along with a diffuse reflection image signal. However, the diffuse reflection image signal and the glossiness signal may be brought together as a single standardized image signal. This image signal may be stored in the image processing apparatus 70 or recorded onto various kinds of recording media. The standardized image signal may also be supplied to the control circuit 22 of the ink jet printer 10.

A case where a diffuse reflection image signal and a glossiness signal are generated using the scanner 31 has been described above. As described below, however, the diffuse reflection image signal and the glossiness signal may be generated by photographing a subject with a camera while changing the illumination direction or light source position by moving a light source or by switching between light sources.

Figure 14A:
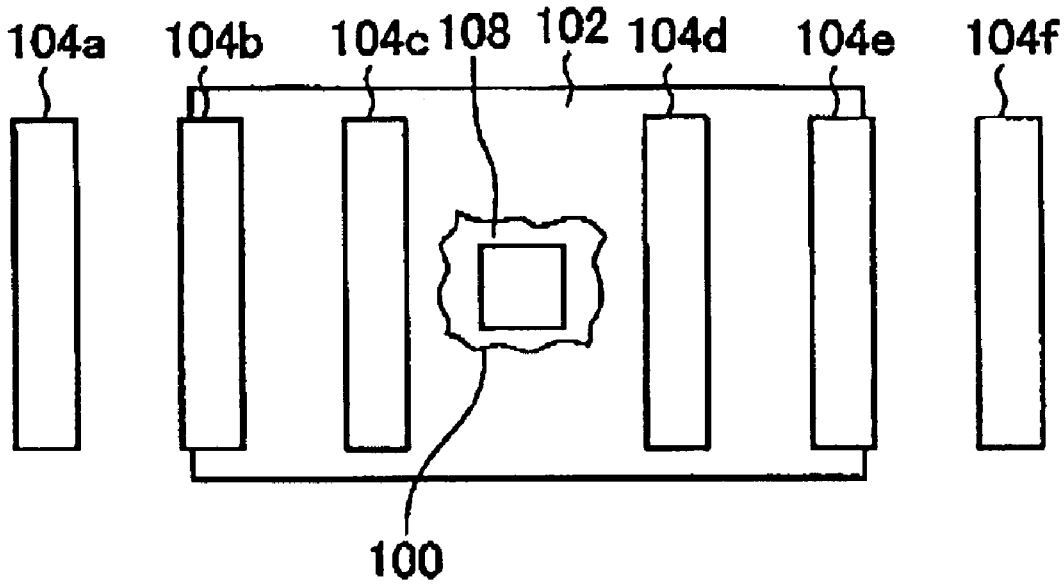
FIGS. 14A and 14B illustrate a method of capturing a subject to generate the glossiness signal and the diffuse reflection image signal applied to the image recording method of the present invention.
Figure 14B:
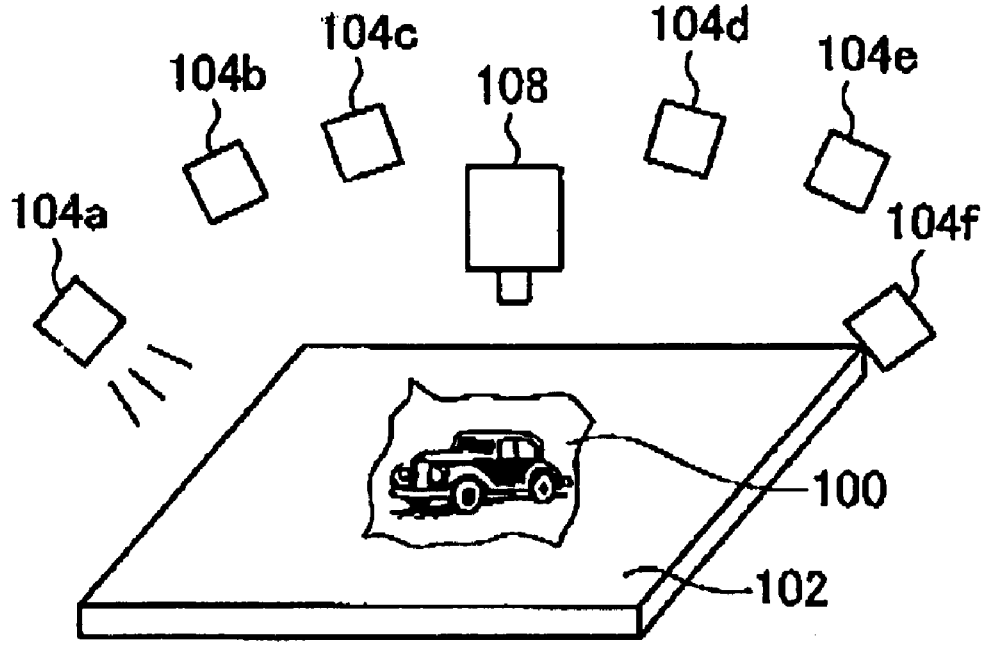
Figure 15:
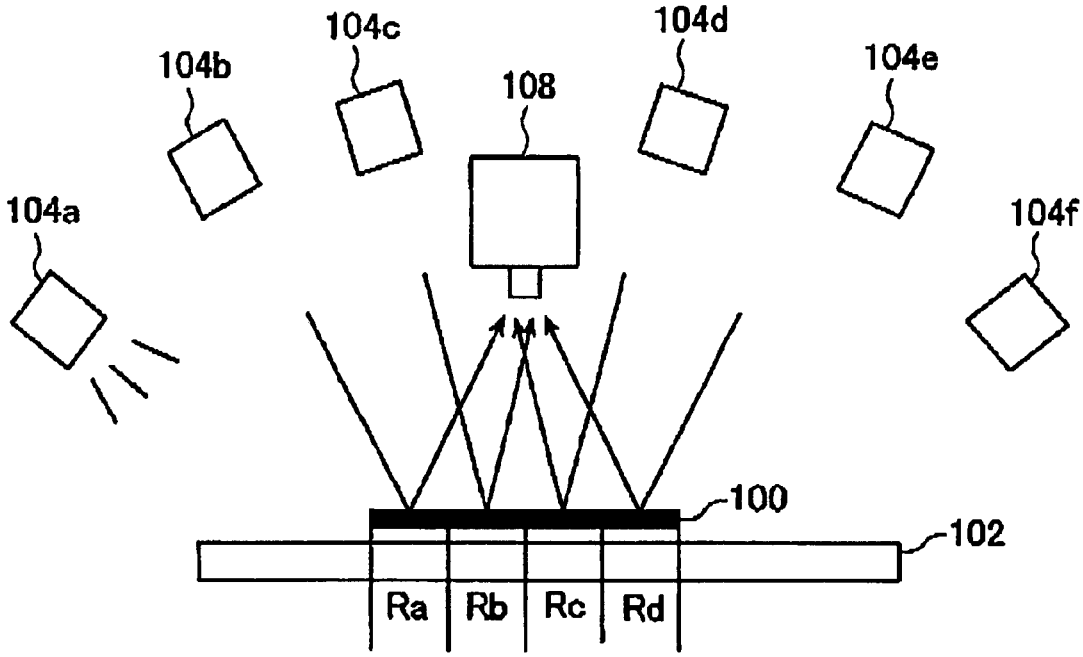
FIG. 15 illustrates a method of generating the glossiness signal and the diffuse reflection image signal applied to the image recording method of the present invention.

For example, as shown in FIGS. 14A and 14B, in the case in which the subject 100 is mounted on the base 102, linear light sources 104*a* to 104*f* extending in one direction are arranged, and the light sources 104*a* to 104*f* are switched by turns to photograph the illuminated subject 100 by the camera 108, the area of the subject 100 is divided into multiple areas such as areas Ra to Rd as shown in FIG. 15, and slopes formed by fine unevenness on the subject surface in each area are classified into slant upward to the right, horizontal and slant upward to the left. Then, based on a positional relationship between the light sources 104*a* to 104*f* and each area, it is checked in advance, for all combinations of the light sources and the areas, if the above-described first glossiness signal $R_1$ is obtained, if the above-described second glossiness signal $R_2$ is obtained or if the above-described third glossiness signal $R_3$ is obtained. Then, associations between the combinations of the light sources and the areas and the first to third glossiness signals are set as shown in Table 1 below. Further, in addition to the capturing by illumination of the light sources 104*a* to 104*f*, diffuse reflection image signals of the subject that is captured by using illumination light containing more diffuse reflection light components than illumination light from the light sources 104*a* to 104*f* are obtained in advance.

TABLE 1

| | Subject surface | Area Ra | Area Rb | Area Rc | Area Rd |
|---|---|---|---|---|---|
| First glossiness signal $R_1$ | Slope upward to the right (/) | Light source 104a | Light sources 104a, 104b | Light sources 104a–104c | Light sources 104a–104d |
| Second glossiness signal $R_2$ | Substantially horizontal surface (—) | Light source 104b | Light source 104c | Light source 104d | Light source 104e |
| Third glossiness signal $R_3$ | Slope upward to the left (\) | Light sources 104c–104f | Light sources 104d–104f | Light sources 104e, 104f | Light source 104f |

Table 1 shows that, in the area Ra for example, specular reflection light by the light source 104*a* is captured if the subject surface is a slope upward to the right, specular reflection light by the light source 104*b* is captured if the subject surface is a substantially horizontal surface, and specular reflection light by the light sources 104*c* to 104*f* is captured if the subject surface is a slope upward to the left. It is set which of the first to third glossiness signals $R_1$ to $R_3$ is obtained according to the classification by such combinations of the light sources 104*a* to 104*f* and the divided areas Ra to Rd of the subject.

For example, as is seen from Table 1, the first glossiness signal $R_1$ is obtained in the area Rb in the case of illumination by the light sources 104*a* and 104*b*. That is, if a maximum value among signal conversion values, which are obtained by converting image signal values in illuminating the subject with each of the light sources 104*a* and 104*b* using the same conversion matrix T as in step 150 shown in FIG. 10, is larger than a signal conversion value of a diffuse image signal that is converted by using the conversion matrix T, a difference obtained by subtracting the signal conversion value of the diffuse image signal from this maximum value is set as a signal value of the first glossiness signal $R_1$, and signal values of the second and third glossiness signals $R_2$, $R_3$ are set at zero.

Similarly, the third glossiness signal $R_3$ is obtained in the case of illumination by the light sources 104*d* to 104*f*. That is, a maximum value among signal conversion values of image signal values in illuminating the subject by each of the light sources 104*d* to 104*f* is larger than a signal conversion value of a diffuse image signal, a difference obtained by subtracting the signal conversion value of the diffuse image signal from this maximum value is set as a signal value of the third glossiness signal $R_3$, and signal values of the first and second glossiness signals $R_1$, $R_2$ are set at zero.

The second glossiness signal $R_2$ is obtained in the same manner.

Although, if there are a plurality of signal conversion values, a maximum value is selected out of the signal conversion values and this maximum value is compared with a signal conversion value of a diffuse image signal in the above-mentioned example, an average value of the plurality of signal conversion values may be used instead of this maximum value.

In this way, in the case in which the subject 100 mounted on the base 102 is photographed and captured by the camera 108, as in the case of capturing a subject using the scanner 31, the signal conversion processing of step 150 shown in FIG. 10 is performed based on a specular reflection image signal of a captured image of the subject 100 obtained by capturing reflected light from the illuminated subject 100 mounted on the planar base 102, whose direction of reflection is in a relationship of substantially specular reflection with respect to an incident direction of illumination light on the subject 100 and the plane of the base 102, and a diffuse reflection image signal of a captured image of the subject 100 obtained by capturing reflected light from the subject 100 whose direction of reflection is in a relationship of diffuse reflection with respect to the incident direction of illumination light on the subject 100 and the plane of the base 102. Thereafter, the first to third glossiness signals $R_1$ to $R_3$ are generated with the method described above and are supplied to the control circuit 22 of the ink jet printer 10 along with the diffuse reflection image signal converted into C, M, and Y signals. In this case, there may be obtained a two-dimensional glossiness signal corresponding to glossiness signal components in two directions including the main scanning direction and conveying direction in the ink jet printer 10. That is, a two-dimensional glossiness signal may be obtained by capturing a specular reflection image by rotating the subject 100 by 90° with reference to the base 102.

The diffuse reflection image signal and glossiness signal in the embodiment described above are created from an image signal of an image captured using a scanner or a camera. In the present invention, however, a diffuse reflection image and a specular reflection image that represent a still subject, whose reflection state varies depending on illumination, may be created with a CG technique, a glossiness signal may be created using these images, and a diffuse reflection image signal and a glossiness signal may be supplied to the control circuit 22 of the ink jet printer 10.

As has been described above, by generating a diffuse reflection image signal and a glossiness signal and by supplying these signals to the ink jet printer 10, the glossy feeling and texture of a subject can be reproduced in the image recorded on a recording medium.

Although the image recording method and ink jet printer of the present invention have been described in detail above, the present invention is not limited to the embodiments described above. That is, needless to say, it is possible to make various kinds of modifications and changes without departing from the gist of the present invention.

As has been described in detail above, in the case where an image is recorded on a recording medium, a gloss adjustment layer is formed in regions in units of pixels of a diffuse reflection image formed on the recording medium, so that it becomes possible to reproduce the glossiness of a subject. Further, the upper surface of the gloss adjustment layer can be made slant to have variations in thickness. As a result, the reflection state resulting from the fine unevenness of the subject can be reproduced and the glossy feeling and the texture of the subject can be reproduced in the image recorded on the recording medium.

What is claimed is:

1. An image recording method of recording an image of a still subject on a recording medium using a diffuse reflection image signal of the image representing the still subject under a state where illumination light is diffuse-reflected and a glossiness signal representing glossiness of the still subject, comprising:

a diffuse reflection image forming step of forming a diffuse reflection image of the still subject on the recording medium based on said diffuse reflection image signal; and a gloss adjusting step of forming a gloss adjustment layer made of a transparent gloss adjustment material in each region in units of pixels of the diffuse reflection image formed on the recording medium based on signal values of the glossiness signal.

2. The image recording method according to claim 1, wherein said diffuse reflection image forming step and said gloss adjusting step are performed by allowing droplets to be ejected onto the recording medium.

3. The image recording method according to claim 1, wherein said gloss adjustment material is one of a gloss suppression material and a gloss material.

4. The image recording method according to claim 1, wherein said gloss adjustment layer is formed in each region corresponding to one pixel of the diffuse reflection image formed on the recording medium in accordance with a formation pattern that has a formation distribution of the gloss adjustment layer that varies in accordance with the signal values of the glossiness signal.

5. The image recording method according to claim 4, wherein said formation pattern has a two-dimensional formation distribution of the gloss adjustment layer within each region of each pixel.

6. The image recording method according to claim 5, wherein:

said glossiness signal contains a first and second glossiness signals;

said gloss adjustment layer is formed in each region in units of pixels of the diffuse reflection image in accordance with the first glossiness signal and the second glossiness signal; and when the formation of the gloss adjustment layer is performed in accordance with the first glossiness signal or the second glossiness signal, an inclination is given to the thickness of the gloss adjustment layer, with a direction of the inclination being different between the first glossiness signal and the second glossiness signal.

7. The image recording method according to claim 6, wherein:

said glossiness signal further contains a third glossiness signals;

said gloss adjustment layer is formed in each region in units of pixels of the diffuse reflection image in accordance with the first glossiness signal, the second glossiness signal and the third glossiness signal;

when the formation of the gloss adjustment layer is performed in accordance with the third glossiness signal, a thickness of the gloss adjustment layer is made constant; and when the formation of the gloss adjustment layer is performed in accordance with one of the first glossiness signal and the second glossiness signal, an inclination is given to the thickness of the gloss adjustment layer, with a direction of the inclination being different between the first glossiness signal and the second glossiness signal.

8. The image recording method according to claim 1, wherein said glossiness signal is generated based on the diffuse reflection image signal and specular reflection image signal of the still subject obtained through specular reflection of illumination light.

9. The image recording method according to claim 8, wherein said diffuse reflection image signal and said specular reflection image signal are respective image signals of a scan-captured image obtained by capturing the whole of the still subject while relatively moving a capturing position with respect to the still subject.

10. The image recording method according to claim 8, wherein:

said diffuse reflection image signal is an image signal of a captured image of the still subject obtained by capturing diffuse reflection light in which a reflection direction of reflection light from the still subject placed on a plane-shaped base and illuminated is in a relationship of diffuse reflection with respect to an incident direction of illumination light onto the still subject and a plane of the plane-shaped base; and said specular reflection image signal is an image signal of a captured image of the still subject obtained by capturing specular reflection light in which a reflection direction of reflection light from the still subject placed on the plane-shaped base and illuminated is in a relationship of substantially specular reflection with respect to an incident direction of illumination light onto the still subject and the plane of the plane-shaped base.

11. The image recording method according to claim 10, wherein said diffuse reflection image signal is an image signal obtained by illuminating the still subject from two different directions at the same time.

12. The image recording method according to claim 11, wherein said illumination light used to obtain the diffuse reflection image signal contains more diffused light components than the illumination light used to obtain the specular reflection image signal.

13. The image recording method according to claim 11, wherein a signal value of said glossiness signal is obtained by subtracting a conversion value obtained by color-converting a signal value of said diffuse reflection image signal from a conversion value obtained by color-converting a signal value of said specular reflection image signal.

14. The image recording method according to claim 10, wherein said diffuse reflection image signal is composed of a first diffuse reflection image signal and a second diffuse reflection image signal obtained by illuminating the still subject from two different directions at different times.

15. The image recording method according to claim 14, wherein said illumination light used to obtain the diffuse reflection image signal contains more diffused light components than the illumination light used to obtain the specular reflection image signal.

16. The image recording method according to claim 14, wherein:

said glossiness signal contains a first, second and third glossiness signals generated based on the diffuse reflection image signal and the specular reflection image signal;

a specular reflection image signal conversion value, a first diffuse reflection image signal conversion value, and a second diffuse reflection image signal conversion value are respectively obtained by color-converting a signal value of the specular reflection image signal, a signal value of the first diffuse reflection image signal and a signal value of the second diffuse reflection image signal;

if a first condition that the specular reflection image signal conversion value is equal to or greater than an average value of the first diffuse reflection image signal conversion value and the second diffused reflection image signal conversion value is satisfied, a difference obtained by subtracting the average value from the specular reflection image signal conversion value is set as a signal value of a third glossiness signal and signal values of first and second glossiness signals are set at zero;

if the first condition is not satisfied and a second condition that the first diffuse reflection image signal conversion value is equal to or greater than the second diffuse reflection image signal conversion value is satisfied, a difference obtained by subtracting the specular reflection image signal conversion value from the first diffuse reflection image signal conversion value is set as the signal value of the second glossiness signal and the signal values of the first and third glossiness signals are set at zero; and if neither of the first condition nor the second condition is satisfied, a difference obtained by subtracting the specular reflection image signal conversion value from the second diffuse reflection image signal conversion value is set as the signal value of the first glossiness signal and the signal values of the second and third glossiness signals are set at zero.

17. The image recording method according to claim 16, wherein:

said gloss adjustment layer is formed in each region in units of pixels of the diffuse reflection image in accordance with the first glossiness signal, the second glossiness signal and the third glossiness signal;

when the formation of the gloss adjustment layer is performed in accordance with the third glossiness signal, a thickness of the gloss adjustment layer is made constant; and when the formation of the gloss adjustment layer is performed in accordance with one of the first glossiness signal and the second glossiness signal, an inclination is given to the thickness of the gloss adjustment layer, with a direction of the inclination being different between the first glossiness signal and the second glossiness signal.

18. An ink jet printer that records an image by ejecting droplets using a diffuse reflection image signal of an image representing a still subject under a state where illumination light is diffuse reflected and a glossiness signal representing glossiness of the still subject, comprising:

an ink jet head that forms a diffuse reflection image on a recording medium by ejecting ink droplets based on a supplied control signal and ejects transparent gloss adjustment liquid onto each region in units of pixels of the diffuse reflection image based on a supplied adjustment signal; and a control circuit that generates the control signal for ejecting the ink droplets based on the diffuse reflection signal, generates the adjustment signal for adjusting the ejection of the gloss adjustment liquid based on the glossiness signal, and supplies the control signal and the adjustment signal to the ink jet head.

* * * * *